US009848706B2

(12) United States Patent
Wang et al.

(10) Patent No.: US 9,848,706 B2
(45) Date of Patent: Dec. 26, 2017

(54) INFLATABLE PRODUCT AND SOFA

(71) Applicant: TEAM WORLDWIDE CORPORATION, Taipei (TW)

(72) Inventors: Cheng-Chung Wang, Taipei (TW); Chien-Hua Wang, Taipei (TW); Yao-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 13 days.

(21) Appl. No.: 14/665,496

(22) Filed: Mar. 23, 2015

(65) Prior Publication Data

US 2015/0265055 A1 Sep. 24, 2015

(30) Foreign Application Priority Data

Mar. 24, 2014 (CN) ..... 2014 1 0112339

(51) Int. Cl.
*A47C 4/54* (2006.01)

(52) U.S. Cl.
CPC ..... *A47C 4/54* (2013.01)

(58) Field of Classification Search
CPC ..... A47C 4/54; A47C 27/081; A47C 27/087; A47C 27/10; A47C 15/006; A47C 31/11; A47C 17/045
USPC ..... 5/655.3
See application file for complete search history.

(56) References Cited

U.S. PATENT DOCUMENTS 1,198,687 A * 9/1916 Williams et al. .... A47C 27/081 297/DIG. 3
2,824,589 A 2/1958 Neisler et al.
2,912,033 A 11/1959 Neisler et al.
4,153,958 A * 5/1979 Paulik ..... A47C 4/52 297/118
4,541,135 A * 9/1985 Karpov ..... A47C 27/081 5/710
4,547,919 A * 10/1985 Wang ..... A42B 3/122 2/18
4,601,667 A * 7/1986 Hull ..... A47C 4/54 114/345
4,644,597 A * 2/1987 Walker ..... A47C 27/087 5/706
5,354,117 A 10/1994 Danielson et al.
6,161,902 A 12/2000 Lieberman
6,763,540 B1 7/2004 Wang
7,089,618 B1 * 8/2006 Metzger ..... A47C 27/087 5/709

(Continued)

FOREIGN PATENT DOCUMENTS

CN 2493102 Y 5/2002
CN 102599761 7/2012

(Continued)

*Primary Examiner* — David E Sosnowski
*Assistant Examiner* — Myles Throop

(57) ABSTRACT

An inflatable product includes a plurality of inflatable bodies, each of which includes an upper edge and an outer periphery, wherein the inflatable bodies are disposed together, an angle X1 between the upper edges of two adjacent inflatable bodies and a contact line of the outer peripheries of the two adjacent inflatable bodies ranges from 0 to 50°, 0≤X1≤50°; and another angle X2 of at least one concave portion formed on the outer periphery by pulling the outer periphery inward ranges from 120° to 180°, 120°≤X2≤180°.

20 Claims, 28 Drawing Sheets

(56) References Cited

U.S. PATENT DOCUMENTS

| | | | | |
|---|---|---|---|---|
| 7,131,701 | B1 * | 11/2006 | Yang | A47C 4/54 297/440.14 |
| 7,328,472 | B2 * | 2/2008 | Chaffee | A47C 7/021 5/655.3 |
| 9,144,318 | B1 * | 9/2015 | Lagier | A47C 17/045 |
| D747,117 | S | 1/2016 | Lau | |
| 9,486,083 | B2 | 11/2016 | Berenson et al. | |
| 2003/0200610 | A1 * | 10/2003 | Wang | A47C 27/081 5/710 |
| 2011/0083280 | A1 * | 4/2011 | Davis | A61G 7/1011 5/712 |
| 2012/0133182 | A1 | 5/2012 | Chiu | |
| 2015/0265056 | A1 * | 9/2015 | Wang | A47C 4/54 297/452.41 |
| 2016/0120331 | A1 * | 5/2016 | Wang | A47C 27/087 5/694 |

FOREIGN PATENT DOCUMENTS

| | | | | |
|---|---|---|---|---|
| CN | 202981089 | | 6/2013 | |
| FR | 1551177 | A * | 12/1968 | A47C 4/54 |

* cited by examiner

INFLATABLE PRODUCT AND SOFA

CROSS REFERENCE TO RELATED APPLICATIONS

This application claims priority of Chinese Patent Application No. 201410112339.0, filed on Mar. 24, 2014, the entirety of which is incorporated by reference herein.

BACKGROUND OF THE INVENTION

Field of the Invention

The invention relates to an inflatable product and a sofa.

Description of the Related Art

Inflatable products, such as inflatable sofas, inflatable beds, inflatable tables, inflatable boat and inflatable toys, are very popular due to their light weight, affordable, portable and convenient characteristics. They are used broadly and become indispensable for people's daily life. Thus they have a bright future in market.

A conventional inflatable product such as an inflatable sofa disclosed in China patent application No. CN 201220600506.2 includes a first gas chamber, a second gas chamber, a gas pipe, an intake valve, an exhaust valve and a gas pump. The first gas chamber has a first gas pressure inside, and the second gas chamber disposed in the first gas chamber has a second gas pressure inside. The first gas pressure is smaller than the second gas pressure. The gas pipe connects the second gas chamber and the gas pump, and the intake valve is disposed on the second gas chamber and within the first gas chamber, and the exhaust valve is disposed on the first gas chamber to release gas from the first gas chamber. Pull straps are disposed within the first gas chamber to divide the first gas chamber into several connected gas paths. The inflatable sofa includes a backrest, a cushion and a leg rest. The backrest corresponds to the first gas chamber, and the cushion corresponds to the second gas chamber.

In this patent application, the second gas chamber is disposed in the first gas chamber, and the first chamber is connected to the second gas chamber or gas paths in the first and second chambers are connected so that it is disadvantageous for gas sealing. When gas leakage occurs in a portion of the sofa, the entire sofa is impacted. In addition, since all of the inflatable bodies are connected to each other, the part of the sofa where a user sits can hardly have the desired shape.

To solve the mentioned problem, a China patent No. CN01230629.0 discloses another inflatable sofa including an inflatable backrest and an inflatable cushion. The inflatable backrest and the inflatable cushion include two or more inflatable units longitudinally or transversely connected to each other. The inflatable unit is a rectangular body including a plurality of small gas bags. The small gas bag is formed by an outer layer and in inner layer. The outer layer is made by emulsion supported by textile, and the inner layer is an elastic bag capable of expanding and shrinking within the outer layer for purging gas. Each small gas bag has an independent unidirectional inflating valve and an independent exhaust valve.

In this patent, the inflatable sofa is formed by longitudinally and transversely connecting inflatable units. Although each inflatable unit is independent, inflation of the inflatable units may affect the connection between two adjacent inflatable units. None of conventional technologies provides a solution for keeping the desired shape of the sofa under pressure.

BRIEF SUMMARY OF THE INVENTION

To address the shortcomings discussed, the invention provides an inflatable product. The inflatable product in accordance with an exemplary embodiment of the invention includes a plurality of inflatable bodies, each of which includes an upper edge and an outer periphery, wherein the inflatable bodies are disposed together, an angle X1 between the upper edges of two adjacent inflatable bodies and a contact line of the outer peripheries of the two adjacent inflatable bodies ranges from 0 to 50°, $0 \leq X1 \leq 50°$; and another angle X2 of at least one concave portion formed on the outer periphery by pulling the outer periphery inward ranges from 120° to 180°, $120° \leq X2 \leq 180°$.

In another exemplary embodiment, each of the inflatable bodies includes an upper member, a bottom member and a periphery member to form the gas chamber, The upper member is fixed to the bottom member by a plurality of vertical pull straps, or the upper member is fixed to the bottom member by a plurality of vertical pull straps and an intermediate member mounted to the periphery member. The periphery member is fixed to the upper member and the bottom member by a plurality of slant pull straps, or the periphery member is fixed to the vertical pull straps by a plurality of transverse pull straps.

In another exemplary embodiment, the inflatable product further includes a gas inflating/deflating device connected to one of the inflatable bodies, at least one connecting member connecting two inflatable bodies, and at least one gas pipe connecting the gas inflating/deflating device and the connecting member, wherein gas is introduced into or released from the inflatable bodies by the gas inflating/deflating device through the connecting member and the gas pipe.

In yet another exemplary embodiment, the inflatable product further includes a gas inflating/deflating device connected to one of the inflatable bodies, a plurality of connecting members connecting the inflatable bodies, and a plurality of gas pipes connecting the gas inflating/deflating device and the connecting members, wherein gas is introduced into or released from the inflatable bodies by the gas inflating/deflating device through the connecting members and the gas pipes.

In another exemplary embodiment, the inflatable product further includes a multiport valve, wherein the gas inflating/deflating device is connected to the gas pipes through the multiport valve to introduce gas into or release gas from the inflatable bodies simultaneously.

In yet another exemplary embodiment, the multiport valve is a multiport check valve, and at least one inflatable body is gas sealed.

In another exemplary embodiment, the connecting member includes a latch connector which is a single port connector having one port, and the gas inflating/deflating device introduces gas into or releases gas from the one of the inflatable bodies through the port of the single port connector.

In yet another exemplary embodiment, the connecting member includes a latch connector which is a double port connector having two ports, and the gas inflating/deflating device introduces gas into or releases gas from the inflatable bodies through the at least one of the ports of the double port connector and the other of the ports is connected to a connecting member of the inflatable bodies through the gas pipe.

In yet another exemplary embodiment, the inflatable product further includes at least one cloth cover which covers at least one inflatable body.

In another exemplary embodiment, the inflatable product further includes a plurality of cloth covers which cover the inflatable bodies, and are joined to each other.

In yet another exemplary embodiment, the cloth cover is hollow and includes an accommodating space which is smaller than a volume of the at least one inflatable body.

In another exemplary embodiment, the cloth cover includes an upper sheet, a lower sheet, and a peripheral sheet connecting the upper sheet and the lower sheet.

In yet another exemplary embodiment, the upper sheet is joined to the peripheral sheet by sewing or zippers, and the lower sheet is joined to the peripheral sheet by sewing or zippers.

In another exemplary embodiment, the cloth cover includes an upper sheet, a plurality of lower sheets, and a peripheral sheet connecting the upper sheet and the lower sheets, and the lower sheets are joined by sewing or zippers.

In yet another exemplary embodiment, the cloth cover includes a plurality of upper sheets, a lower sheet, and a plurality of peripheral sheets connecting the upper sheets and the lower sheet, and the peripheral sheets are joined by sewing.

In another exemplary embodiment, the cloth cover includes a plurality of upper sheets, a lower sheet, and a plurality of peripheral sheets connecting the upper sheets and the lower sheet, and the peripheral sheets and the upper sheets are joined by sewing.

In yet another exemplary embodiment, the cloth cover includes a plurality of upper sheets, a lower sheet, and a plurality of peripheral sheets connecting the upper sheets and the lower sheet, and the upper sheets are joined by sewing.

In another exemplary embodiment, the cloth covers are joined by sewing, attaching or latching.

In yet another exemplary embodiment, the inflatable product further includes a plurality of securing members disposed between the upper sheet and the lower sheet.

In another exemplary embodiment, the inflatable product further includes a plurality of securing members disposed on diagonal corners of the peripheral sheet.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

The First Embodiment

Figure 1:
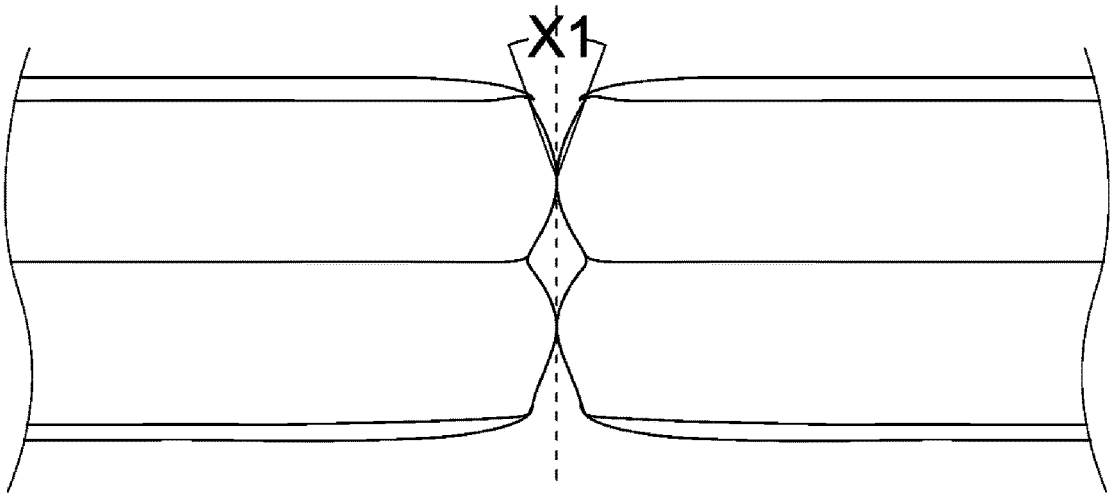
FIG. 1 is a schematic view of two adjacent inflatable bodies of the invention.
Figure 2:
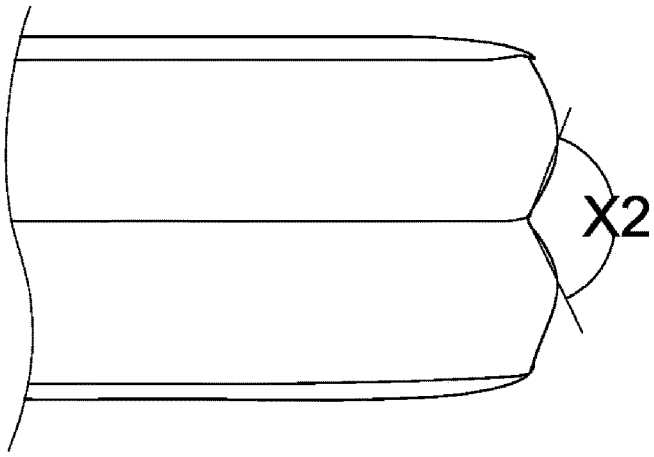
FIG. 2 is a schematic view of a concave portion on an outer periphery of an inflatable body of the invention.

Referring to FIGS. 1 and 2, the invention discloses an inflatable product. The inflatable product of the invention includes a plurality of inflatable bodies joined together. Each of the inflatable bodies has an independent inflatable structure. Each of the inflatable bodies has an upper edge and an outer periphery. When two inflatable bodies are disposed side by side, the outer periphery of one of the inflatable bodies contacts the outer periphery of the other of the inflatable bodies. An angle X1 between two lines extending from the contact point to the upper edges of the two inflatable bodies ranges from 0 to 50°, $0 \leq X1 \leq 50°$. In addition, a concave portion is formed on the outer periphery through a transverse pull strap or at least one slant transverse pull strap pulling the outer periphery inwards. The angle X2 between two lines extending from a trough of the concave portion to two peaks adjacent to the trough respectively ranges from 120° to 180°, $120° \leq X2 \leq 180°$.

Figure 3A:
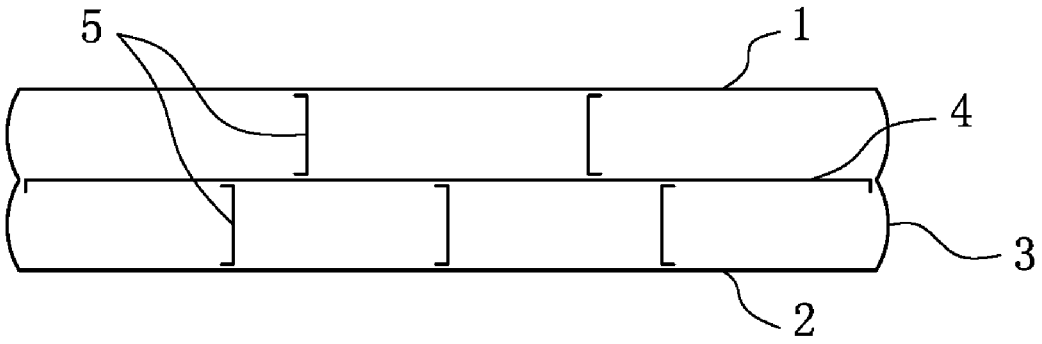
FIGS. 3*a*-3*c* depict pull traps disposed in inflatable bodies of the invention.
Figure 3B:
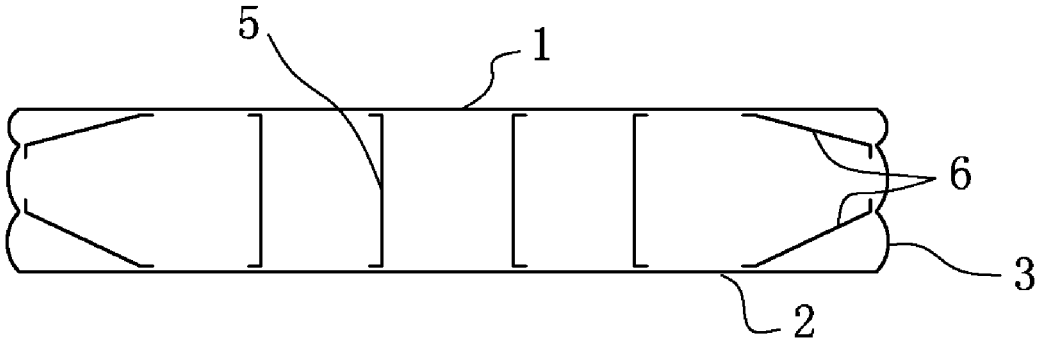
Figure 3C:
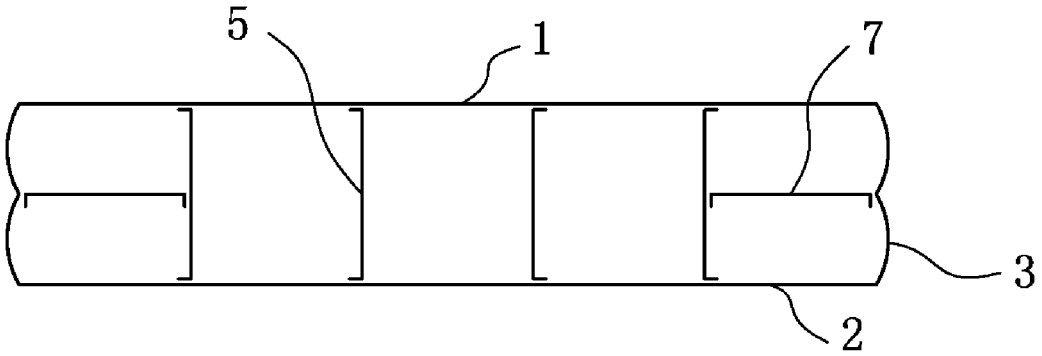

Furthermore, referring to FIGS. 3*a*, 3*b* and 3*c*, the inflatable body has a chamber capable of receiving gas. The inflatable body of this embodiment includes an upper member 1, a bottom member 2 and a peripheral member 3 to form the gas chamber. As shown in FIG. 3*a*, an intermediate member 4 is mounted to the peripheral member 3. The upper member 1 and the bottom member 2 are secured to the intermediate member 4 by a plurality of vertical pull straps 5 respectively. As shown in FIG. 3*b*, the upper member 1 is secured to the bottom member 2 directly by vertical pull straps 5, and the peripheral member 3 is secured to the upper member 1 or bottom member 2 by a plurality of slant pull straps 6. As shown in FIG. 3*c*, the upper member 1 is secured to the bottom member 2 directly by vertical pull straps 5, and the peripheral member 3 is secured to the vertical pull straps 5 by a plurality of transverse pull straps 7. All arrangements and modifications of the securing structure for the upper member 1 and the bottom member 2 are encompassed in the scope of the invention.

Figure 4A:
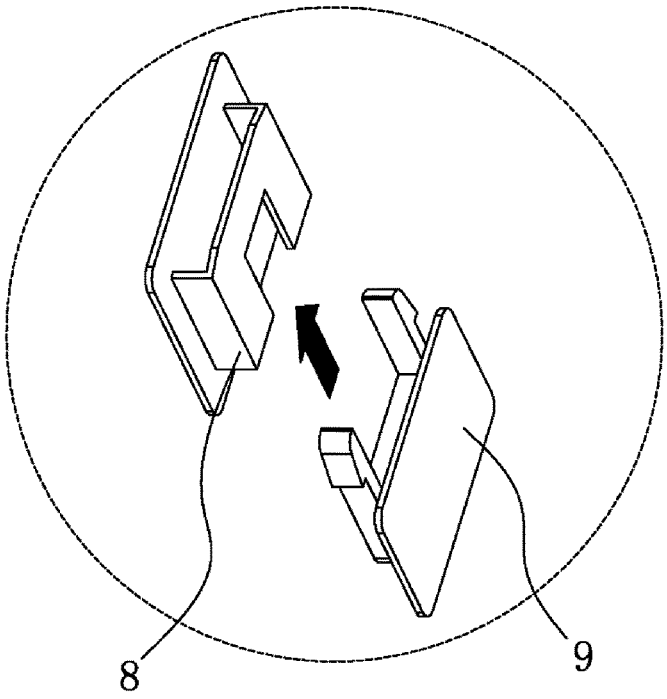
FIGS. 4*a* and 4*b* depict a connecting member of latch type of the invention.
Figure 4B:
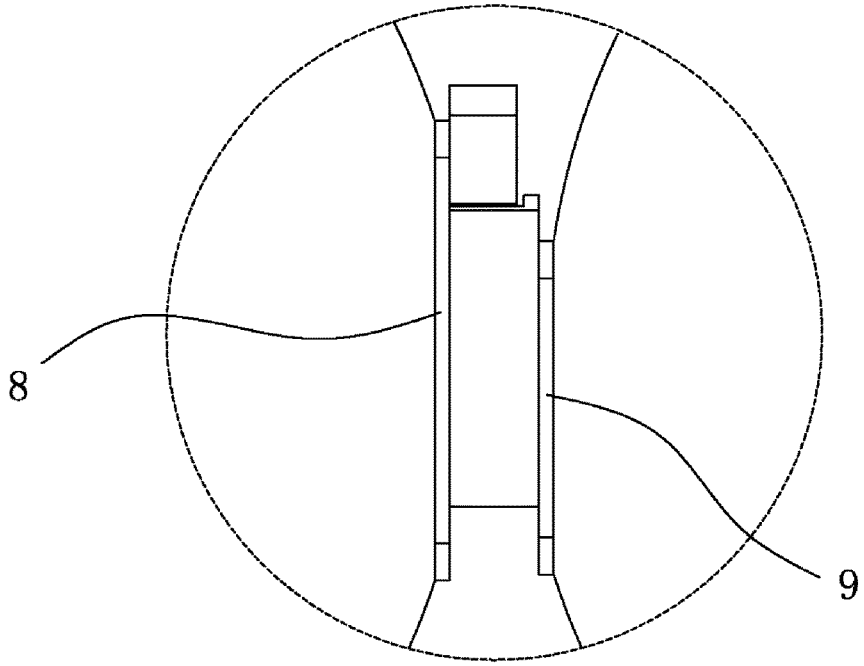

Referring to FIGS. 4*a* and 4*b*, the inflatable bodies are assembled through connecting members that may be latch type, screw type, Velcro, or other kinds of connecting members. In this embodiment, a quick female fastener 8 and a quick male fastener 9 are disposed on two adjacent inflatable bodies to perform quick connection therebetween.

Figure 5:
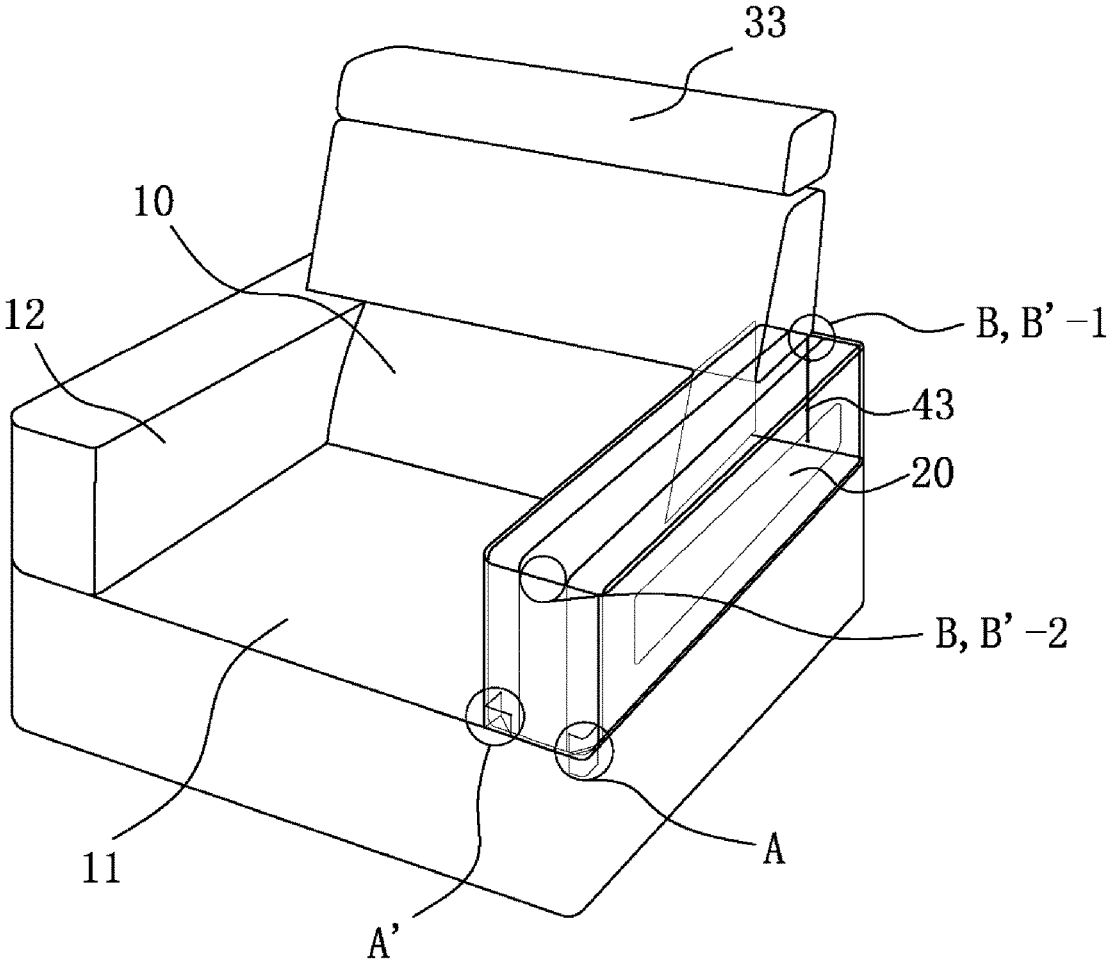
FIG. 5 is a perspective view of a sofa of the invention including cloth covers, shaping members.
Figure 6:
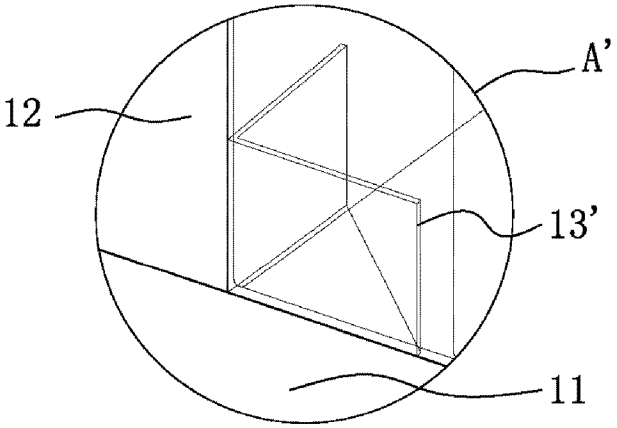
FIG. 6 is an enlarged view of the portion A' of FIG. 5.
Figure 7:
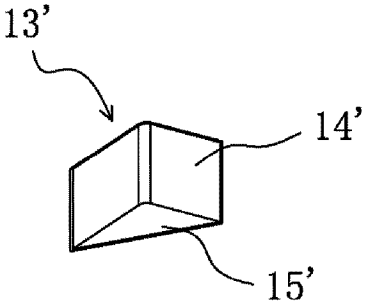
FIG. 7 is a perspective view of a single-end shaping member of the invention.
Figure 8:
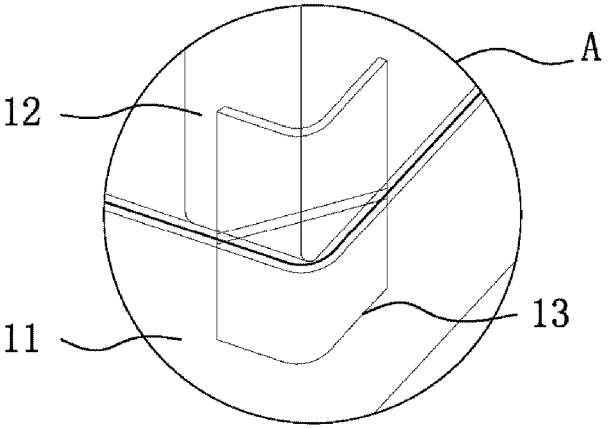
FIG. 8 is an enlarged view of the portion A of FIG. 5.
Figure 9:
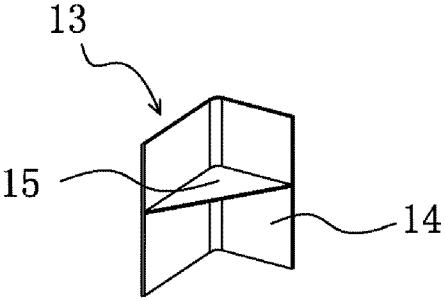
FIG. 9 is a perspective view of a double-end shaping member of the invention.

Referring to FIGS. 5 to 9, a sofa is described as an example in this embodiment. As shown in FIG. 5, the sofa includes a backrest, a cushion and two armrests. The inflatable bodies include backrest inflatable body 10, cushion inflatable body 11 and armrest inflatable body 12. A shaping member 13 is disposed at a corner of the inflatable body to flatten the corner. The shaping member 13 has a shape corresponding to a shape of the corner. The portions A and A' of FIG. 5 show the curved shaping members are disposed at a lower edge of the armrest inflatable body and at an upper edge of the cushion inflatable body. FIG. 6 is the portion A' of FIG. 5, and FIG. 9 is the portion A of FIG. 5. Referring to FIGS. 7 and 9, the shaping member 13 (or 13') includes two plates 14 (or 14') connected to each other to form an L shape and a triangular partition plate 15 (or 15') connecting to inner sides of the two plates 14 (or 14').

Figure 11:
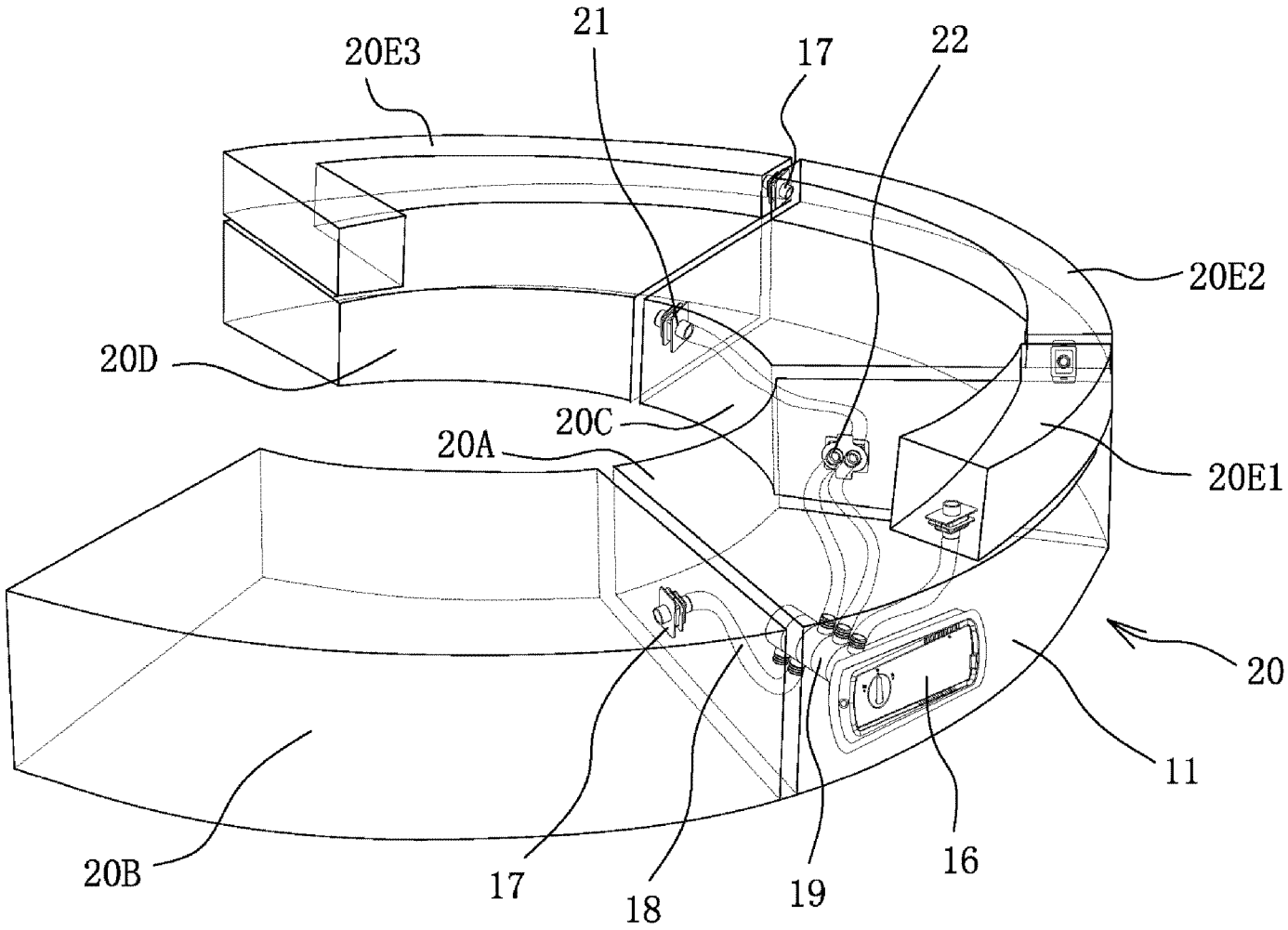
FIG. 11 is a perspective view of an inflatable product including several inflatable bodies of the invention.

FIG. 11 shows a sofa assembly 20 including four sofas assembled to form a semicircular shape. The sofa assembly 20 includes a gas inflating/deflating device 16, multiport valve 19, a single port connector 17, a multiple port connector 22 and gas pipe 18. The gas inflating/deflating device 16 is disposed on or joined to an inflatable body 20A. The single port connector 17 is disposed on an inflatable body 20B and connects two adjacent inflatable bodies 20A and 20B. The gas inflating/deflating device 16 is connected to the multiple port connector 22 through the gas pipe 18 and simultaneously introduces gas into the adjacent inflatable body 20A or simultaneously releases gas from the adjacent inflatable body 20A, or the gas inflating/deflating device 16 simultaneously introduces gas into other corresponding inflatable bodies 20B, 20C, 20D, 20E1, 20E2 and 20E3 or simultaneously releases gas from other corresponding inflatable bodies 20B, 20C and 20D, 20E1, 20E2 and 20E3 through several gas pipe 18 and multiple port connectors 22. The gas inflating/deflating device 16 is a gas pump.

Figure 12:
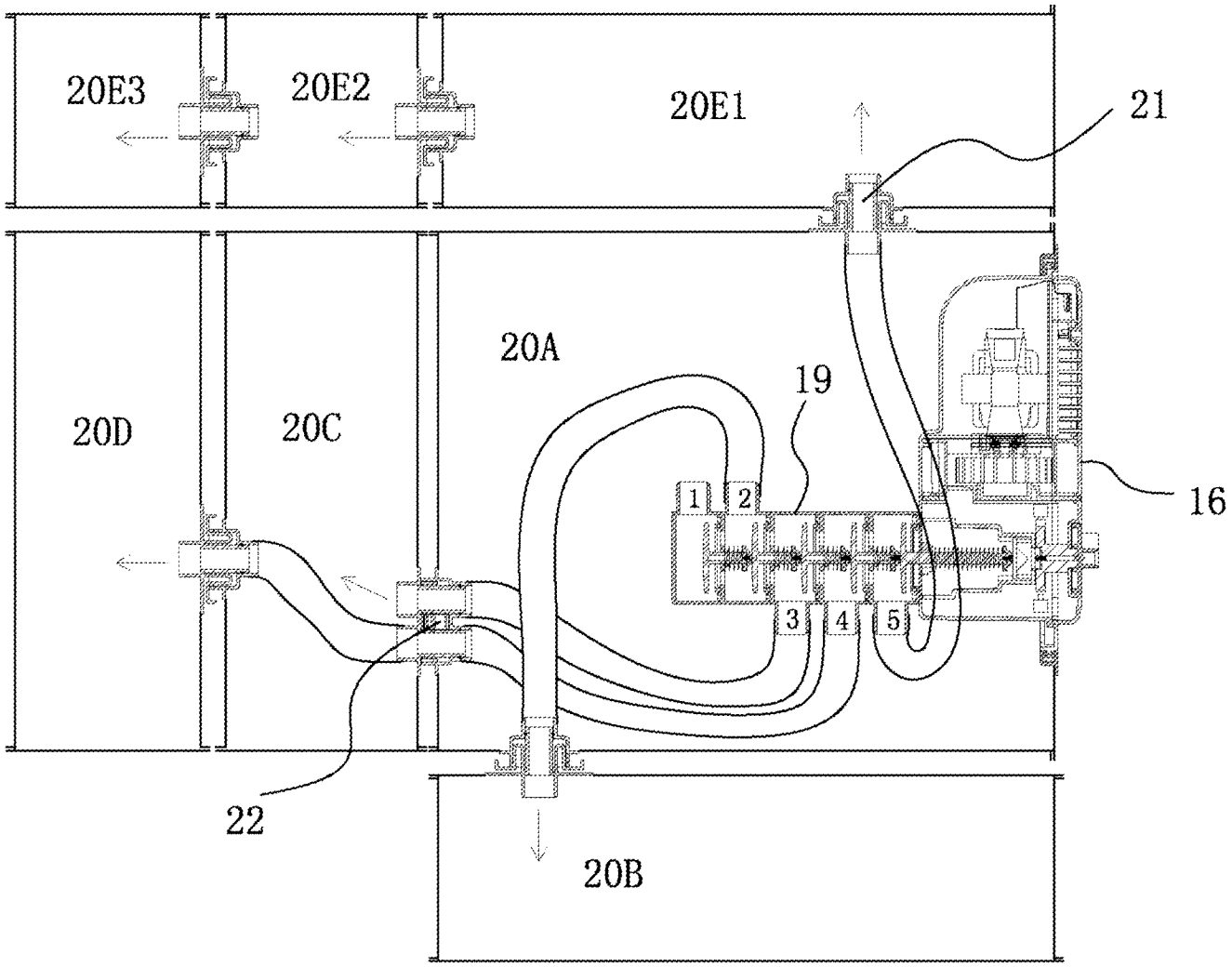
FIG. 12 is a top view of an inflatable product including several inflatable bodies of the invention.

Referring to FIG. 12, when the multiport valve 19 is opened, the gas inflating/deflating device 16 introduces gas into cushion 20A directly through the port 1 of the multiport valve 19, into cushion 20B through the port 2 of the multiport valve 19, a gas pipe and a single port connector, into cushion 20C through the port 3 of the multiport valve 19, a gas pipe and one port of a double port connector 22, and into cushion 20D through the port 4 of the multiport valve 19, two gas pipes, the other port of the double port connector 22 and a single port connector. The gas inflating/deflating device 16 also introduces gas into backrest 20E1 through the port 5 of the multiport valve 19, a gas pipe and a single port connector 21. The gas flowing into the backrest 20E1 is further introduced into backrest 20E2 through a single port connector and even further into backrest 20E3 through a single port connector.

The gas inflating/deflating device 16 is connected to each of the inflatable bodies 20A, 20B, 20C and 20D, 20E1, 20E2 and 20E3 through the multiport valve 19 and the gas pipes 18 to simultaneously introduce gas into the inflatable bodies 20A, 20B, 20C and 20D, 20E1, 20E2 and 20E3 or simultaneously release gas from the inflatable bodies 20A, 20B, 20C and 20D, 20E1, 20E2 and 20E3.

The multiport valve 19 can be a multiport check valve to maintain at least a part of the inflatable bodies independently gas-sealed. Since the multiport valve 19 is a multiport check valve, it is capable of maintaining each of the inflatable bodies 20A, 20B, 20C and 20D, 20E1, 20E2 and 20E3 independently gas-sealed and preventing gas in one of the inflatable body 20A, 20B, 20C and 20D, 20E1, 20E2 and 20E3 from flowing into other of the inflatable bodies 20A, 20B, 20C and 20D, 20E1, 20E2 and 20E3 when gas is introduced into or released from the inflatable bodies 20A, 20B, 20C and 20D, 20E1, 20E2 and 20E3.

Figure 13A:
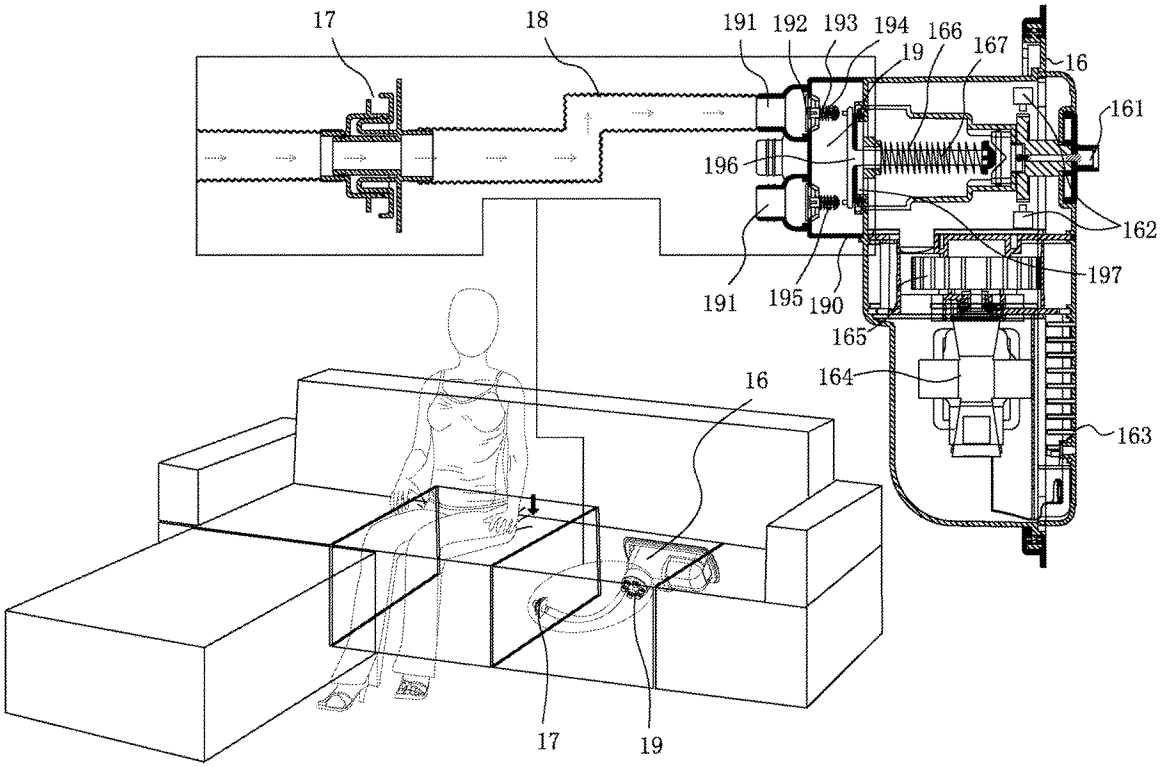
FIG. 13*a* a perspective view of another inflatable product including several inflatable bodies of the invention.

Referring to FIG. 13, the multiport valve 19 includes a base 190, connecting ports 191, rubber pad 192, a pad seat 193 disposed on the rubber pad 192, a spring 194 disposed on the pad seat 193 and a spring holder 195 holding the spring 194. The base 190 includes a valve gate 197. A plate 196 is disposed at the valve gate 197. When plate 196 is pushed to open the valve gate 197, the plate 196 props against the spring seat 195 so as to push the rubber pad 192 through the pad seat 193, and thus the connecting port 191 is opened, whereby gas can flow into the inflatable body through the connecting port 191. When the plate 196 is released to close the valve gate 197, the plate 196 leaves the pad seat 193 so that the rubber pad 192 is pulled to seal the connecting port 191 by the spring 194, whereby inflatable body is gas sealed.

The gas inflating/deflating device 16 includes a housing, a knob 161, inflating/deflating switch 162, a gas exhaust port 163, a motor 164, fan 165, a spring 166, and a push rod 167. The knob 161 and the inflating/deflating switch 162 are on the housing, and the spring 166, the push rod 167, the inflating/deflating switch 162, the motor 164 and the fan 165 are disposed in the housing. The push rod 167 is connected to the plate 196, and the fan 165 is connected to a shaft of the motor 164. The knob 161 controls the movement of the push rod 167 so as to control the plate 196. The plate 196 controls the rubber pad 192 to open or close the connecting port 191. Furthermore, the knob 161 rotates to trigger the inflating/deflating switch 162 so as to control the motor 164 to introduce gas into the inflatable body or release gas from the inflatable body.

Figure 13B:
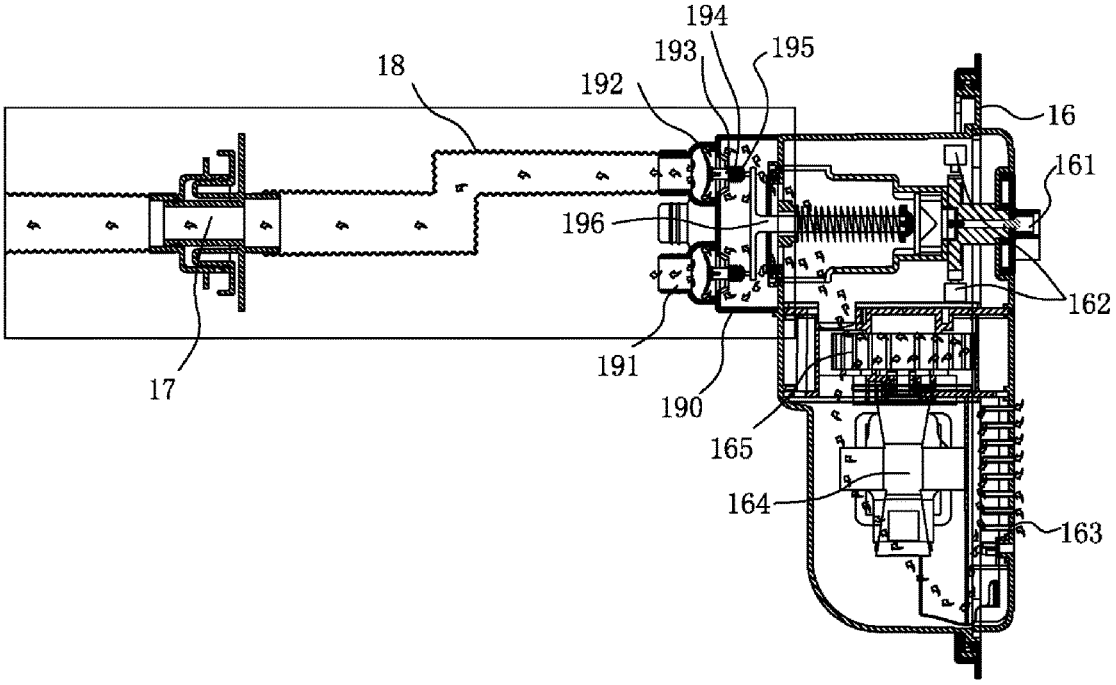
FIG. 13*b* depicts gas introduced into the inflatable product of FIG. 13*a;*

Referring to FIG. 13*b*, when the inflatable body is inflated, the knob 161 is rotated to a position corresponding to a gas inflating mode to trigger the inflating/deflating switch 162 and to push the push rod 167 and the plate 196 to open the rubber pad 192. The motor 164 rotates the fan 165 to drive air from an intake/exhaust port 163 into the inflatable body through the multiport check valve 19, the single port connector 17, the double port connector and the gas pipes 18. When the gas inflating is completed, the knob 161 returns to its original position, and the push rod 167 returns through the spring force of the spring 166 to close the plate 196 so as to close the rubber pad 192.

Figure 13C:
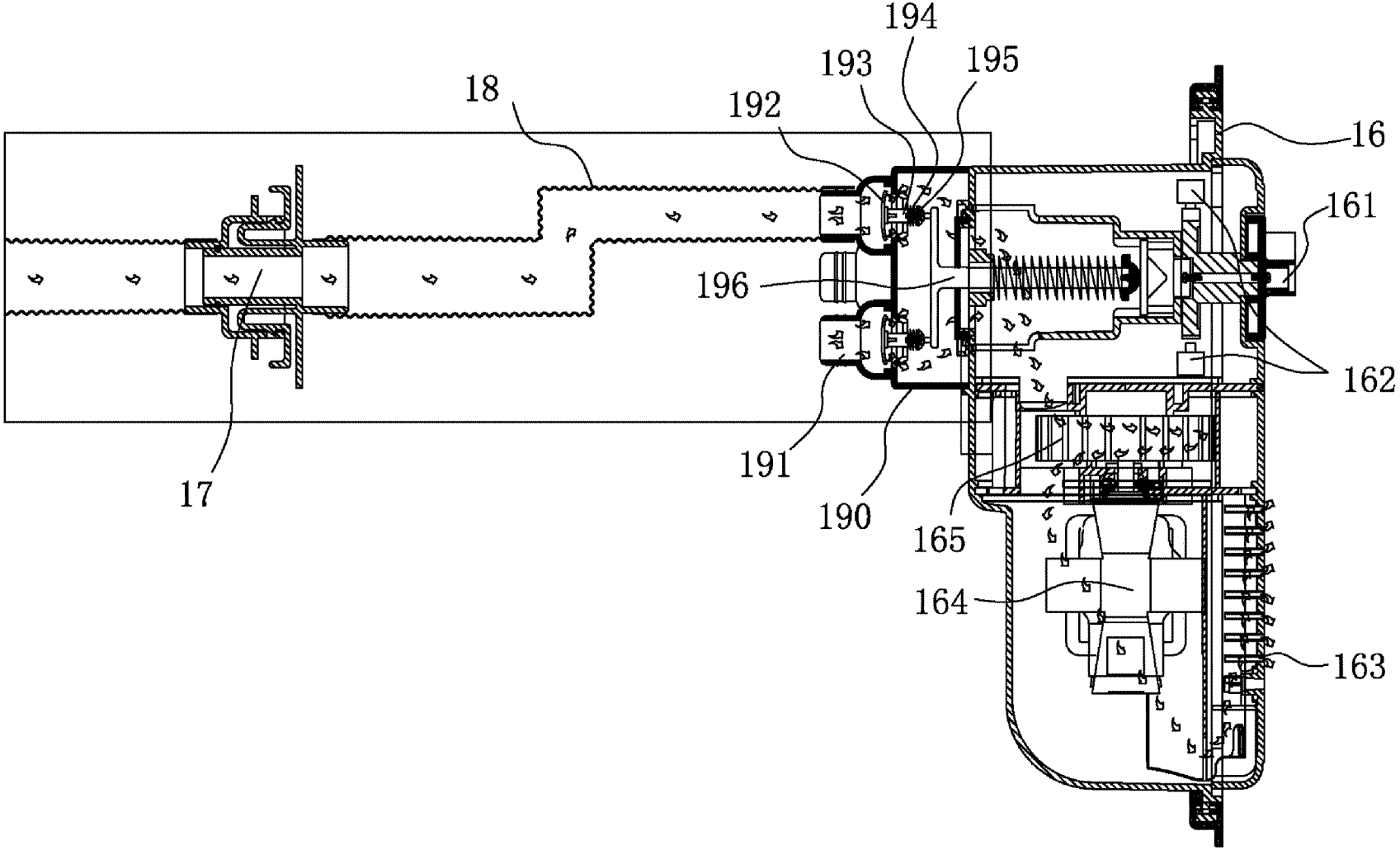
FIG. 13*c* depicts gas released from the inflatable product of FIG. 13*a;*

Referring to FIG. 13*c*, when gas is to be released from the inflatable body, the knob 161 is rotated to a position corresponding to a gas release mode to trigger the inflating/deflating switch 162 and to push the push rod 167 and the plate 196 to open the rubber pad 192. The motor 164 rotates the fan 165 to draw air from each of the inflatable bodies to an external environment through the multiport check valve 19, the single port connector 17, the double port connector and the gas pipes 18. When the gas deflating is completed, the knob 161 returns its original position, and the push rod 167 returns through the spring force of the spring 166 to close the plate 196 so as to close the rubber pad 192.

Referring to FIGS. 14*a*, 14*b*, 15*a*, 15*b*, 16*a*, and 16*b*, the connector can be a single port connector 21 or a double port connector 22. The gas inflating/deflating device 16 introduces gas into or releases gas from an adjacent inflatable body 20 through the single port connector 21. The gas inflating/deflating device 16 introduces gas into or releases gas from an adjacent inflatable body 20 through one port of the double port connector 22, and introduces gas into or releases gas from other inflatable bodies through the other port of the double port connector 22 connecting to the gas pipes. A shown in FIGS. 11 to 12, the gas inflating/deflating device 16 introduces gas into or releases gas from the cushion A directly through the port 1 of the multiport valve 19. The gas is introduced into or released from the cushion B through the port 2 of the multiport valve 19, a gas pipe 18 and a single port connector 21. The gas is introduced into or released from the cushion C through the port 3 of the multiport valve 19, a gas pipe 18 and one port of the double port connector 22. The gas is introduced into or released from the cushion D through the port 4 of the multiport valve 19, two gas pipes 18, the other port of the double port connector 22 and another single port connector. The gas inflating/deflating device 16 also introduces gas into backrest E1 through the port 5 of the multiport valve 19, a gas pipe and a single port connector 21, and the gas flowing into the cushion E1 is further introduced into backrest E2 through a single port connector and even further into backrest E3 through a single port connector. The single port connector 17 (latch connector) is disposed outside the inflatable body or disposed on the inflatable body. The gas pipe 18 is disposed outside or within the inflatable body.

Figure 14A:
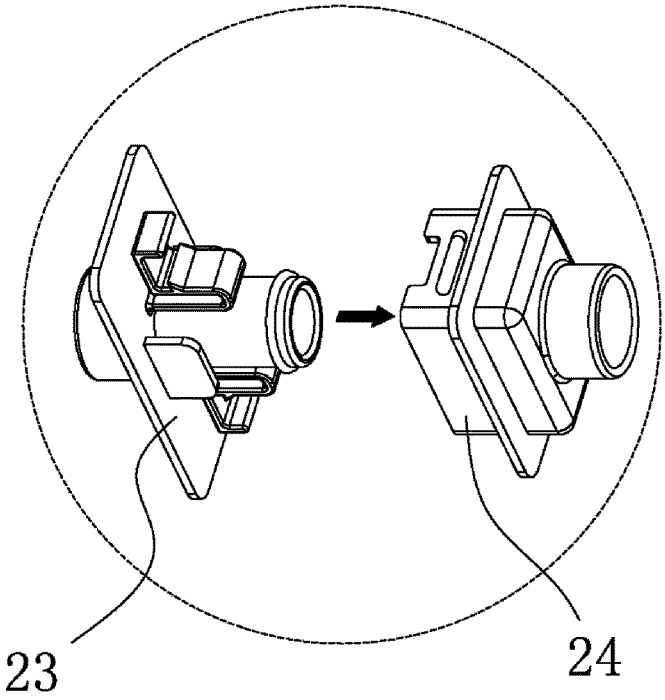
FIG. 14*a* is a perspective view of a single-port connecting member of the invention.
Figure 14B:
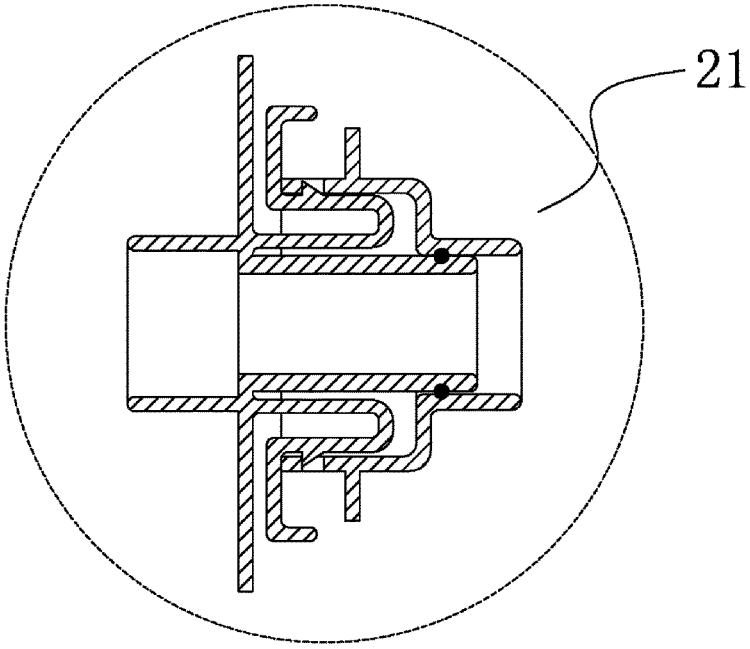
FIG. 14*b* is a cross section of a single-port connecting member of the invention.
Figure 15A:
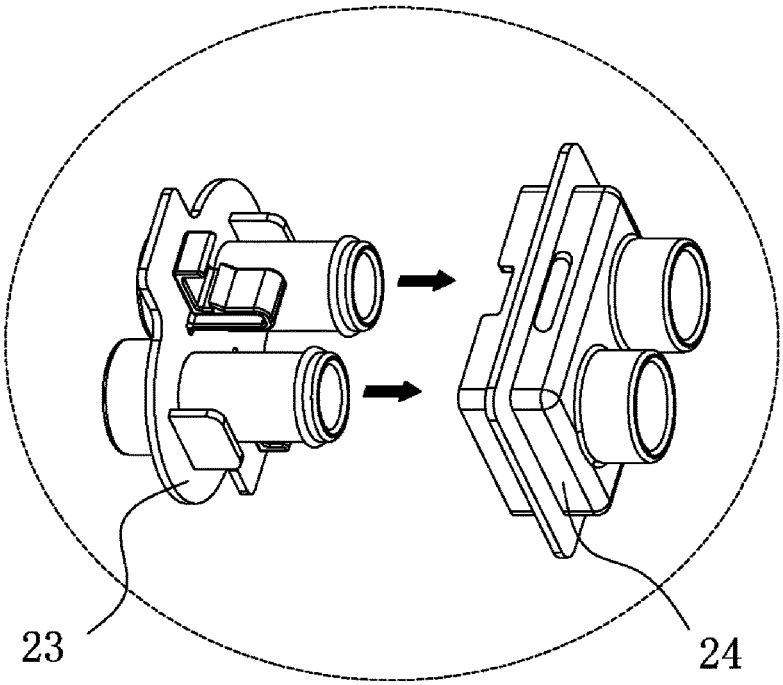
FIG. 15*a* is a perspective view of a double-port connecting member of the invention.
Figure 15B:
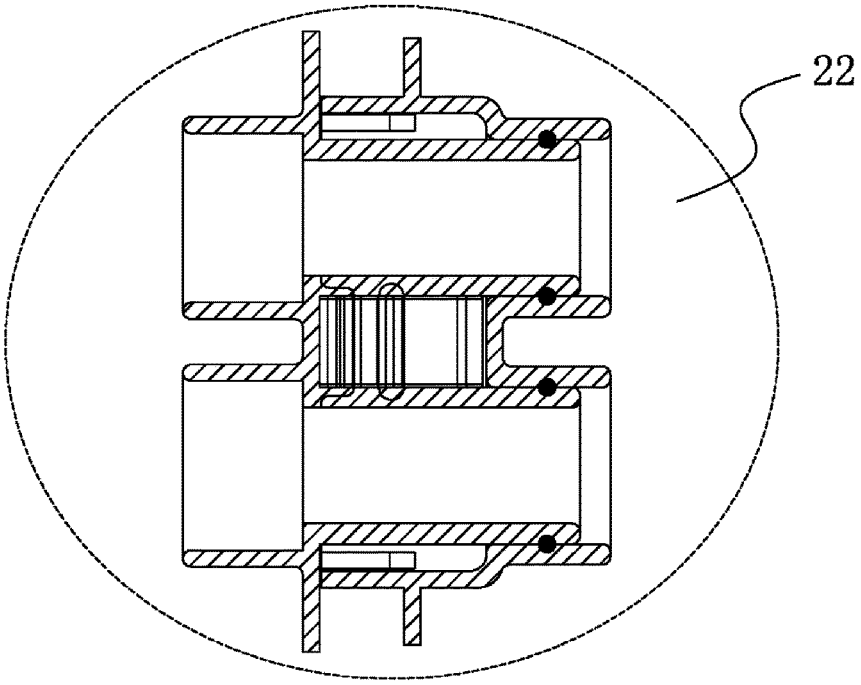
FIG. 15*b* is a cross section of a double-port connecting member of the invention.
Figure 16B:
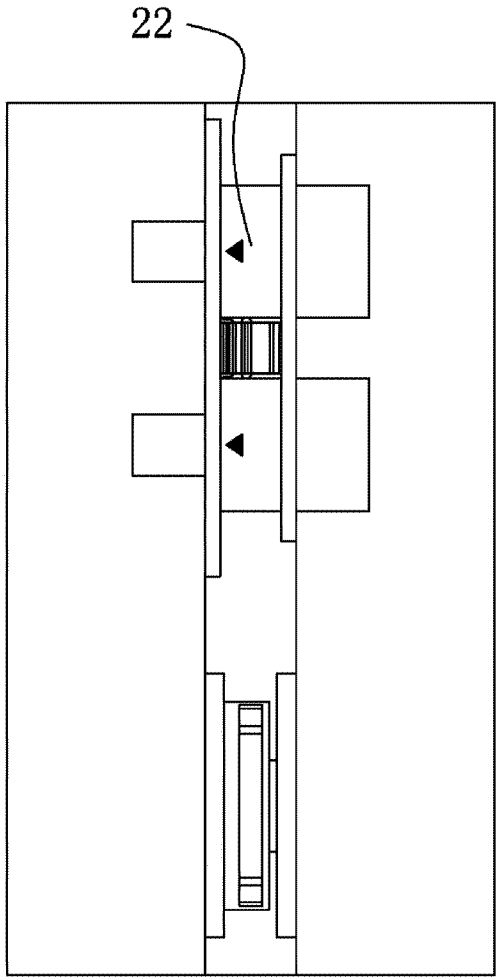
FIG. 16*b* is a top view of a double-port connecting member connecting two inflatable bodies.
Figure 16A:
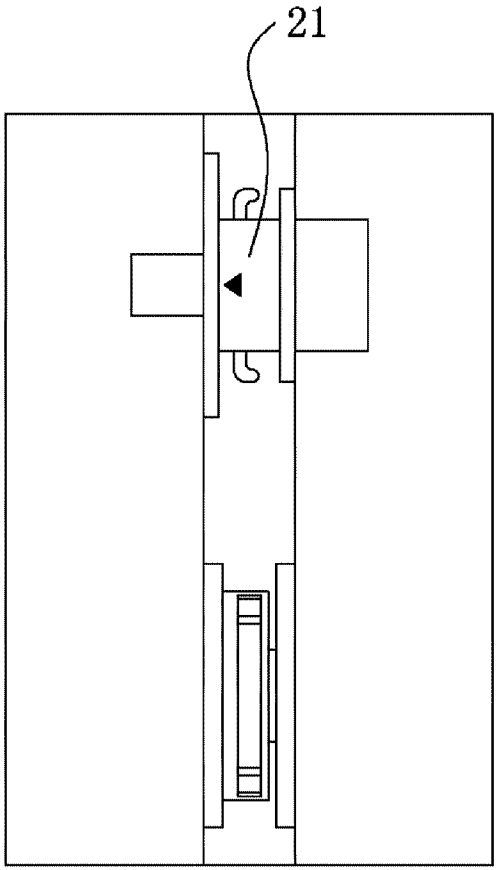
FIG. 16*a* is a top view of a single-port connecting member connecting two inflatable bodies.

As shown in FIGS. 14*a*, 14*b*, the single port connector 21 includes a male connecting element 23 disposed on one inflatable body 20 and a female connecting element 24 disposed on another inflatable body 20. When gas is to be introduced into or released from the inflatable body 20, the male connecting element 23 disposed on the inflatable body 20 engages with the female connecting element 24 disposed on another adjacent inflatable body 20. FIGS. 15*a* and 15*b* show the double port connector 22. Similarly, the double port connector 22 also includes a male connecting element 23 disposed on one inflatable body 20 and a female connecting element 24 disposed on another inflatable body 20. When gas is to be introduced into or released from the inflatable body 20, the male connecting element 23 disposed on the inflatable body 20 engages with the female connecting element 24 disposed on another adjacent inflatable body 20. FIGS. 15*a* and 15*b* show the double port connector 22. FIG. 16*a* shows an assembled single port connector 21, and FIG. 16*b* shows an assembled double port connector 22. Although the single port connector 21 has a latch structure (latch type) in this embodiment, other structures such as a screw formed on the male connecting element and female connecting element (screw type) is also encompassed in the scope of the invention.

The Second Embodiment

This embodiment is a modification of the first embodiment. In this embodiment, the inflatable bodies in the first embodiment are covered by cloth covers. At least one of the inflatable bodies is covered by a cloth cover. The cloth covers are connected to each other. The cloth cover is hollow and capable of receiving the inflatable body. A cloth cover includes an upper sheet, a lower sheet and a peripheral sheet connecting the upper sheet and the lower sheet.

Figure 17A:
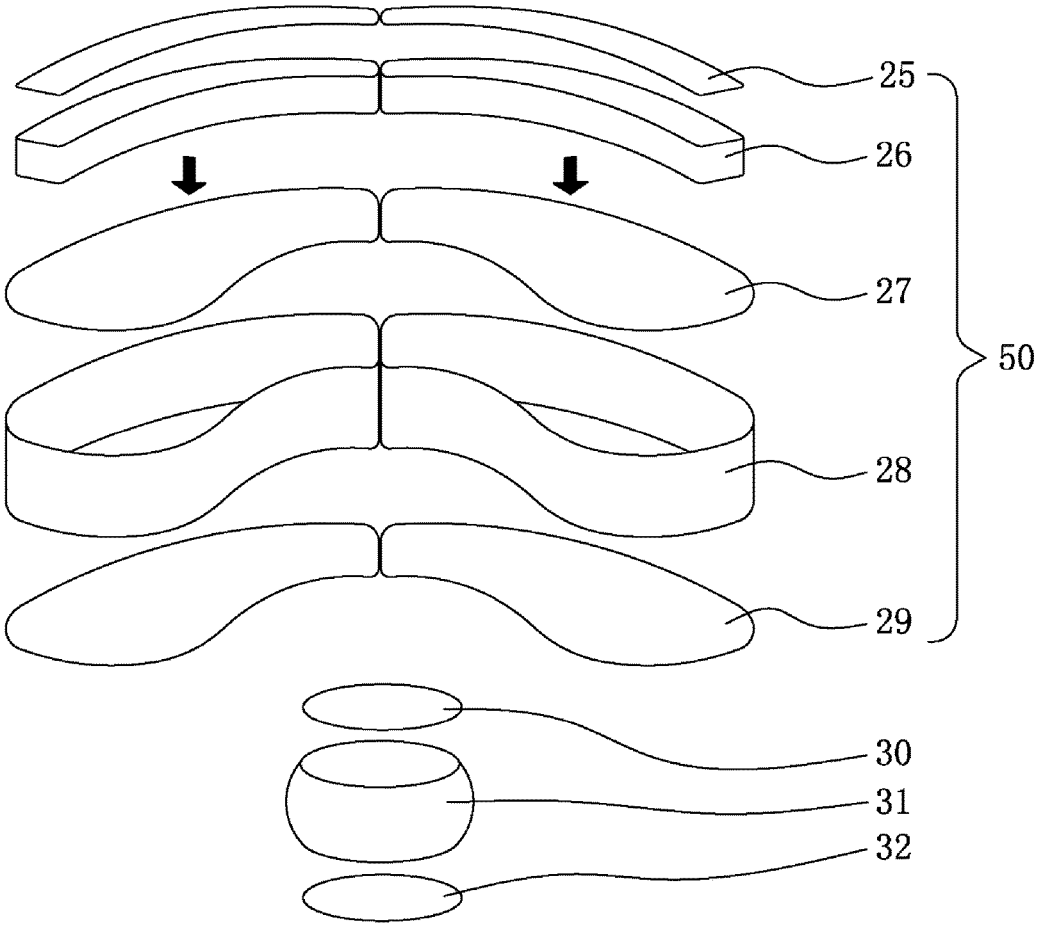
FIG. 17*a* is an exploded view of a sofa assembly of the invention.
Figure 17B:
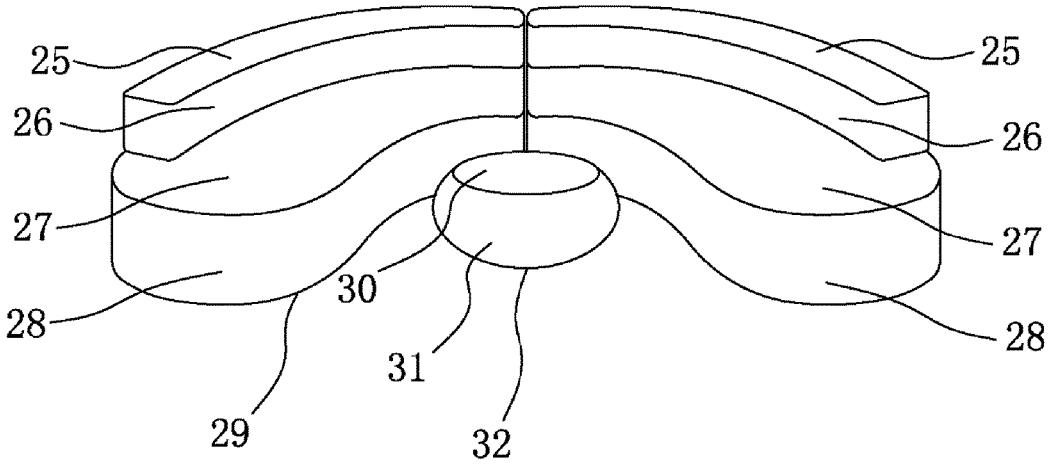
FIG. 17*b* is a perspective view of a sofa assembly of the invention.

Referring to FIGS. 17*a* and 17*b*, a twin sofa set is described as an example for this embodiment. The twin sofa set includes a twin sofa and a coffee table. The twin sofa set is covered by a twin sofa cloth cover set 50. The twin sofa cloth cover set 50 includes a backrest upper sheet 25, a backrest peripheral sheet 26, a cushion upper sheet 27, a cushion peripheral sheet 28, and a cushion lower sheet 29. The coffee table set is covered by a coffee table cloth cover. The coffee table cloth cover includes a coffee table upper sheet 30, a coffee table peripheral sheet 31 and a coffee table lower sheet 32.

Figure 18A:
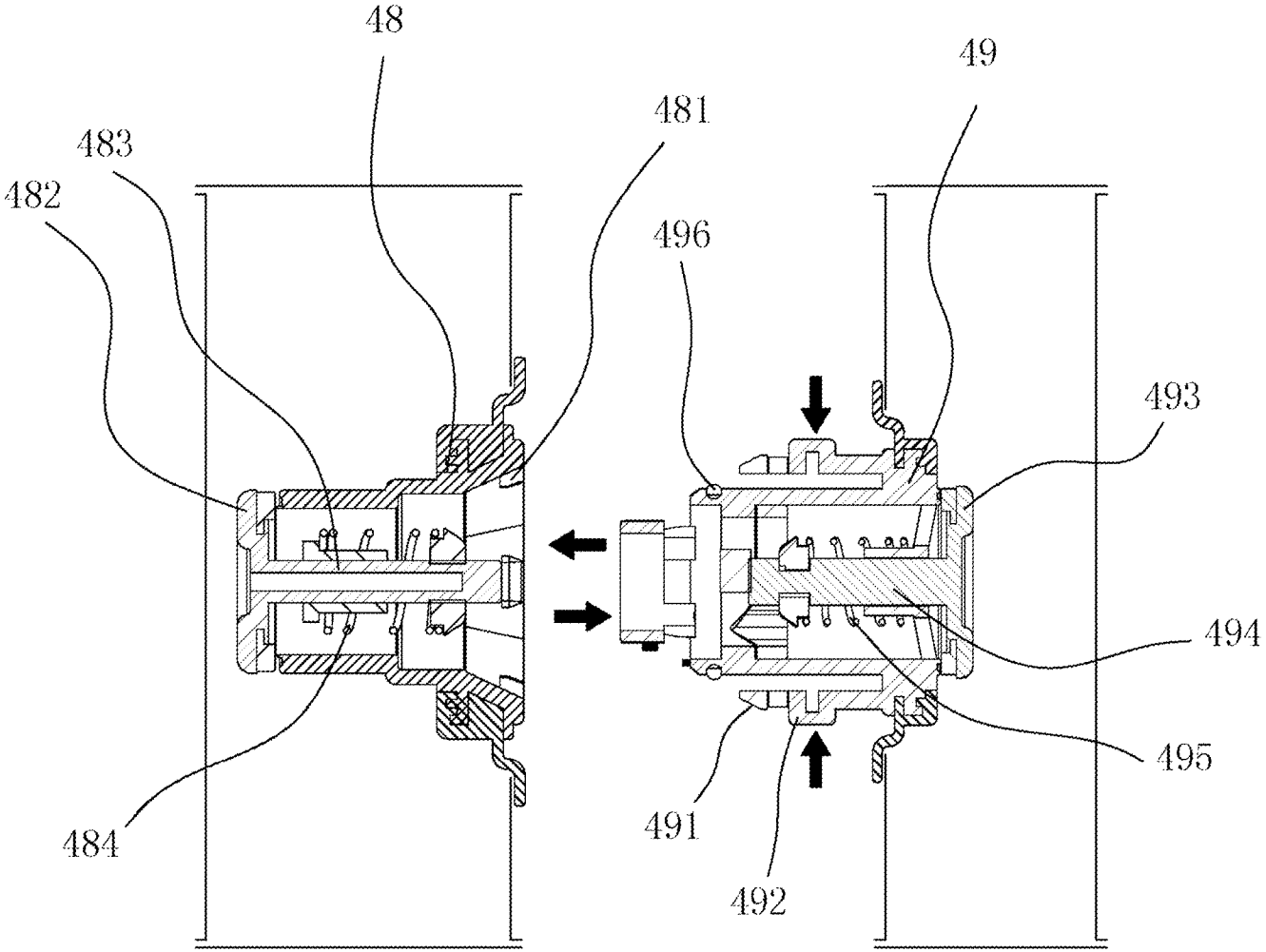
FIG. 18*a* depicts a connecting member engaging another connecting member of the invention.
Figure 18B:
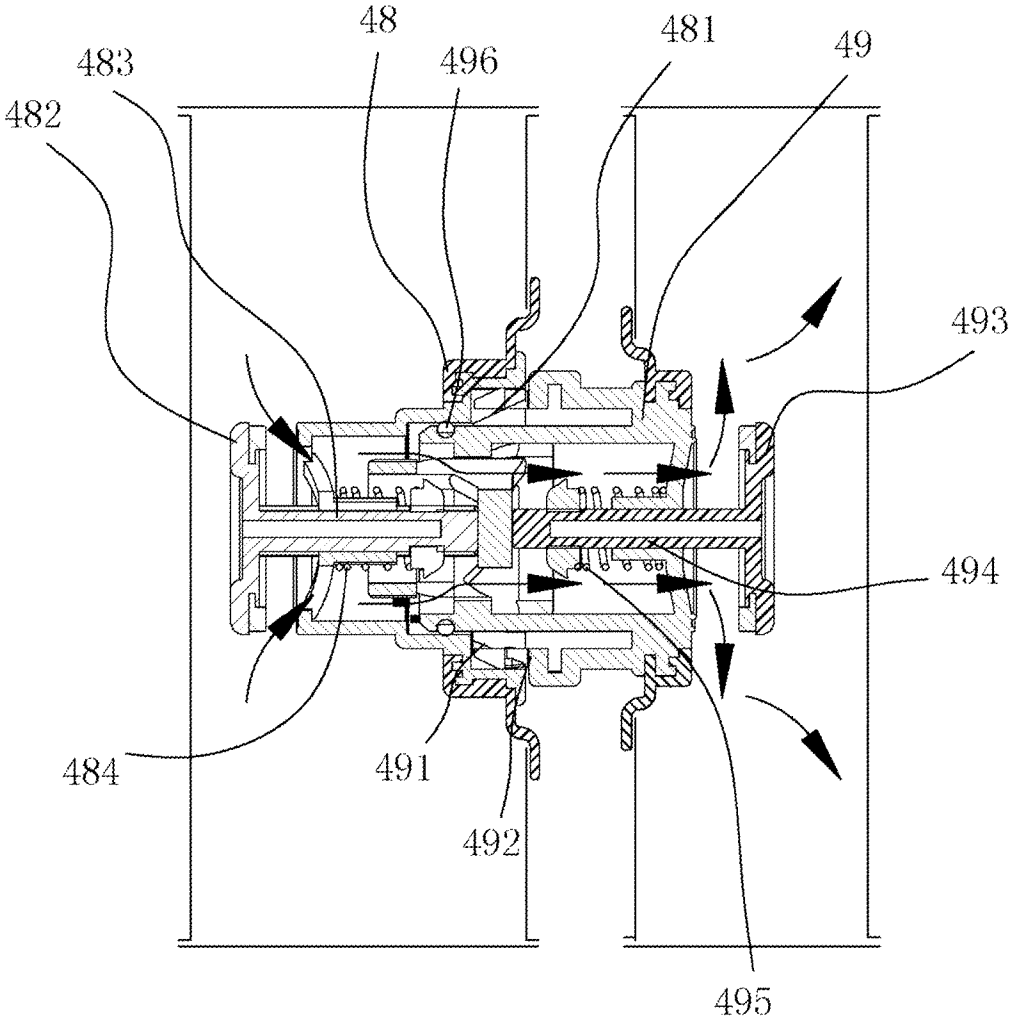
FIG. 18*b* depicts gas flowing into a coffee table from an inflatable sofa via the engaged connecting members.
Figure 18C:
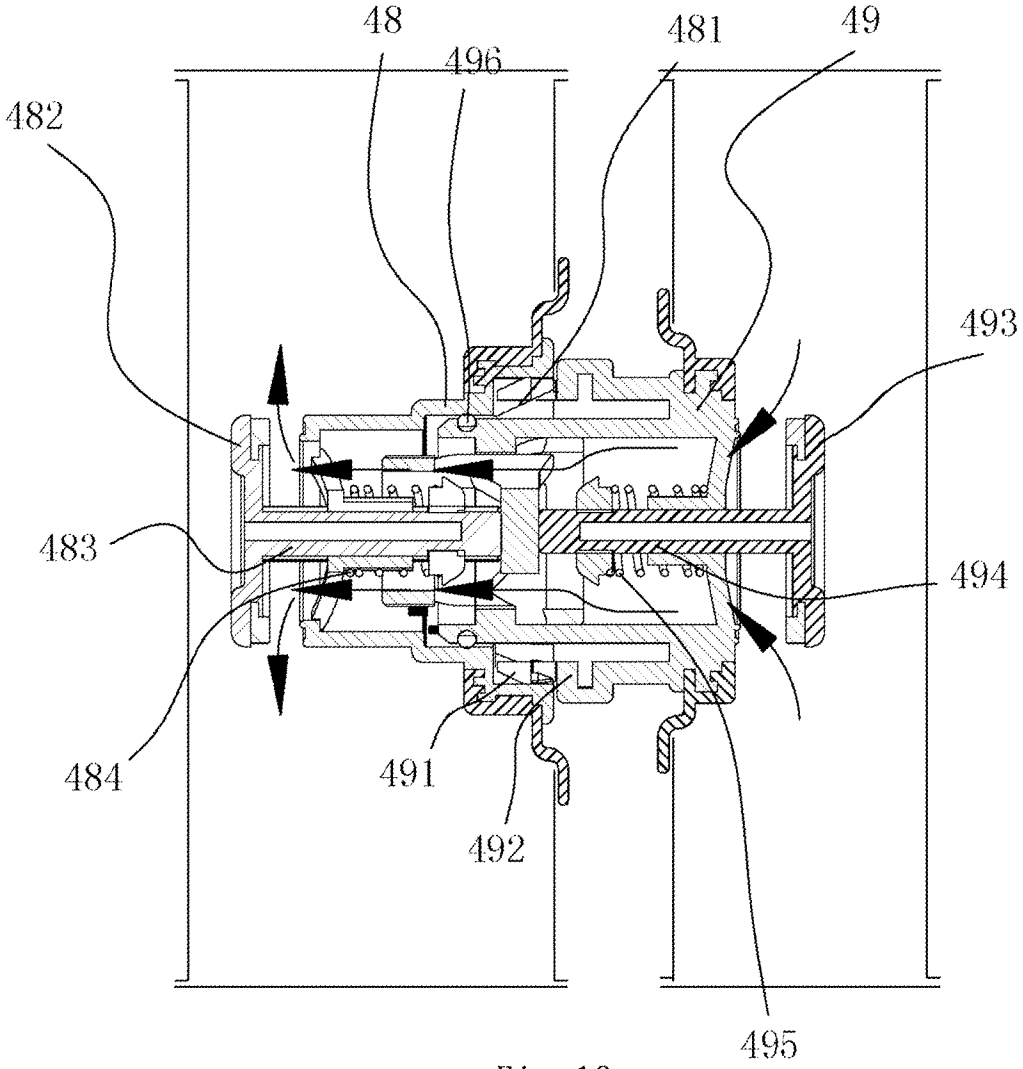
FIG. 18*c* depicts gas flowing into an inflatable sofa from a coffee table via the engaged connecting members.
Figure 18D:
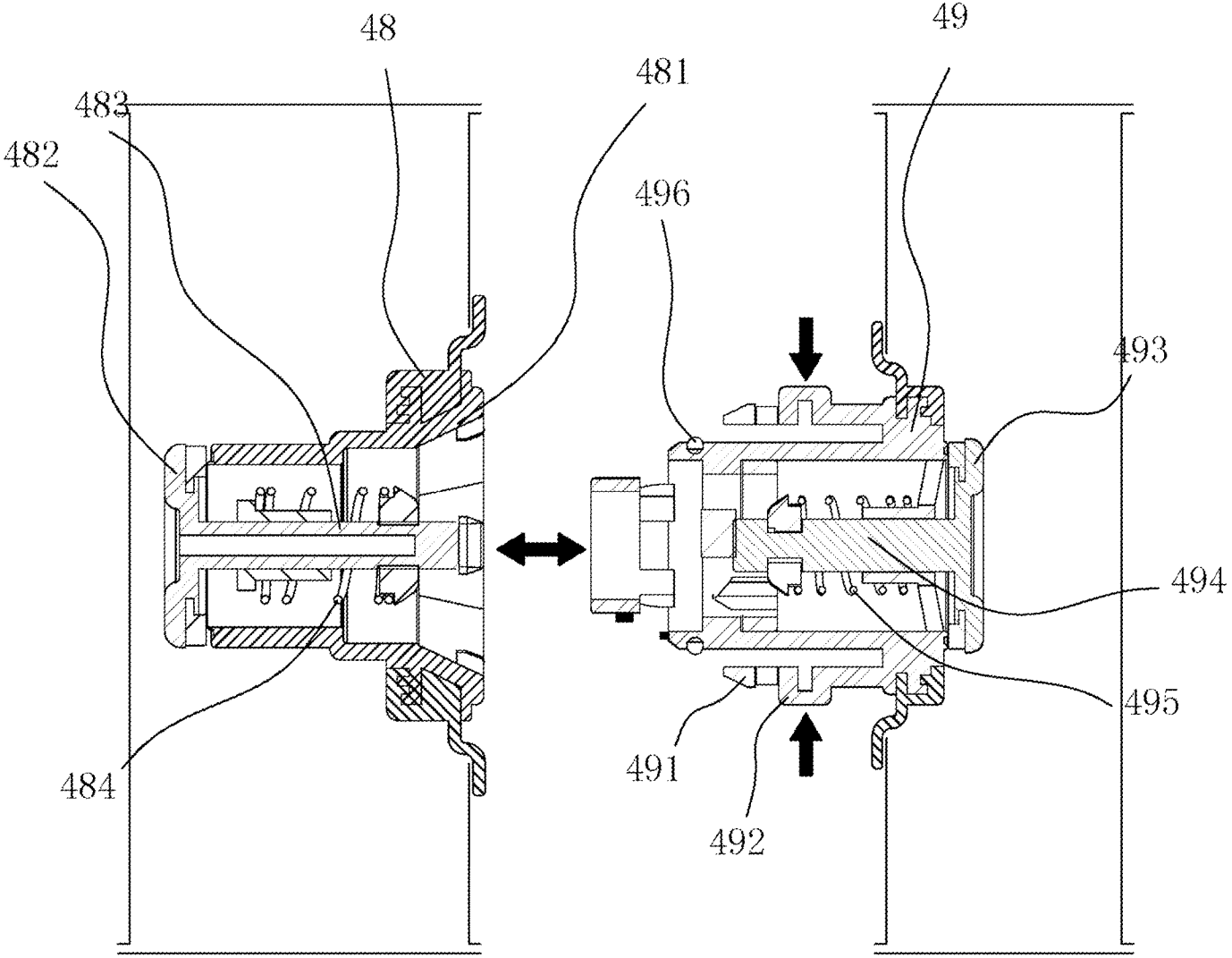
FIG. 18*d* depicts a connecting member is released from another connecting member.

Referring to FIG. 18*a*, a connecting member 48 is disposed on inflatable bodies of the twin sofa and a connecting member 49 is disposed on the inflatable body of the coffee table set. The connecting member 48 includes a connecting portion 481, a valve 482, a valve stem 483, a spring 484 and the connecting member 49 includes a connecting portion 491, a latch 492, a valve 493, a valve stem 494 a spring 495 and a sealing O-ring 496. When the connecting portion 481 engages with the connecting portion 491 by the latch 492, a valve port of the connecting member 48 and a valve port of the connecting member 49 are opened. Referring to FIG. 18*b*, when the connecting member 48 engages with the connecting member 49, the valve stem 483 pushes the valve stem 494 to open the valve 482 and the valve 492 and the sealing O-ring 496 seals the connecting portion 481 and the connecting portion 491, whereby gas flows from the inflatable body of the twin sofa to the inflatable body of the coffee table set through the engaged connecting members 48 and 49, whereby the coffee table is inflated. Referring to FIG. 18*c*, gas flows from the inflatable body of the coffee table set to the inflatable body of the twin sofa through the engaged connecting members 48 and 49, whereby gas is released from the coffee table. Referring to FIG. 18*d*, when the latch 492 is pushed to separate the connecting members 48 and 49, the valve 482 of the connecting member 48 and the valve 493 of the connecting member 49 are closed so that the twin sofa and the coffee table are gas sealed independently.

The cloth cover set 50 is hollow and has an accommodating space which is smaller than a volume of the inflatable body. The cloth cover set 50 limits the inflation of the inflatable bodies to protect thermal welding lines of the inflatable body from damage caused by over inflation.

Figure 19A:
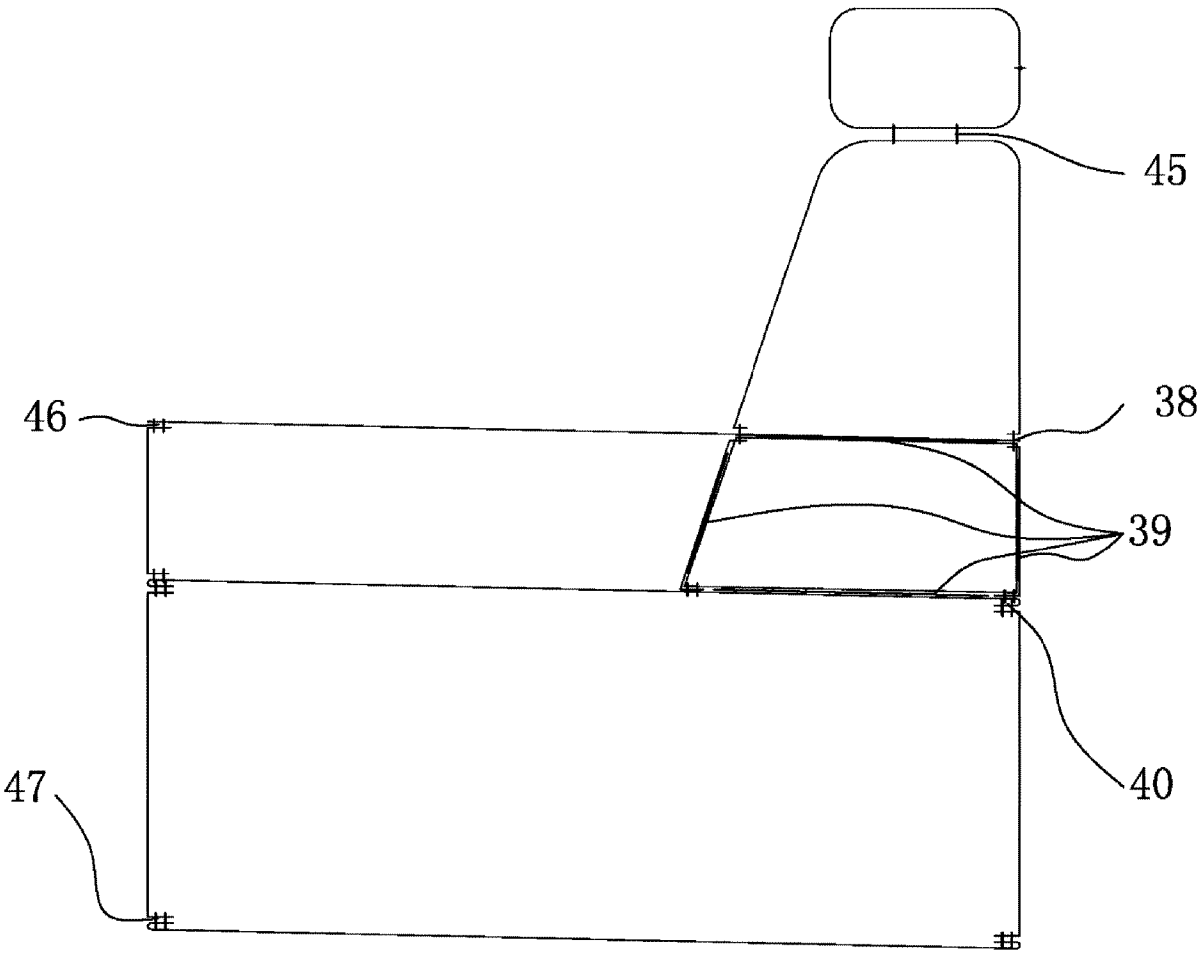
FIG. 19*a* depicts a lower end of a backrest cloth cover joined to a upper end of a cushion cloth cover.
Figure 19B:
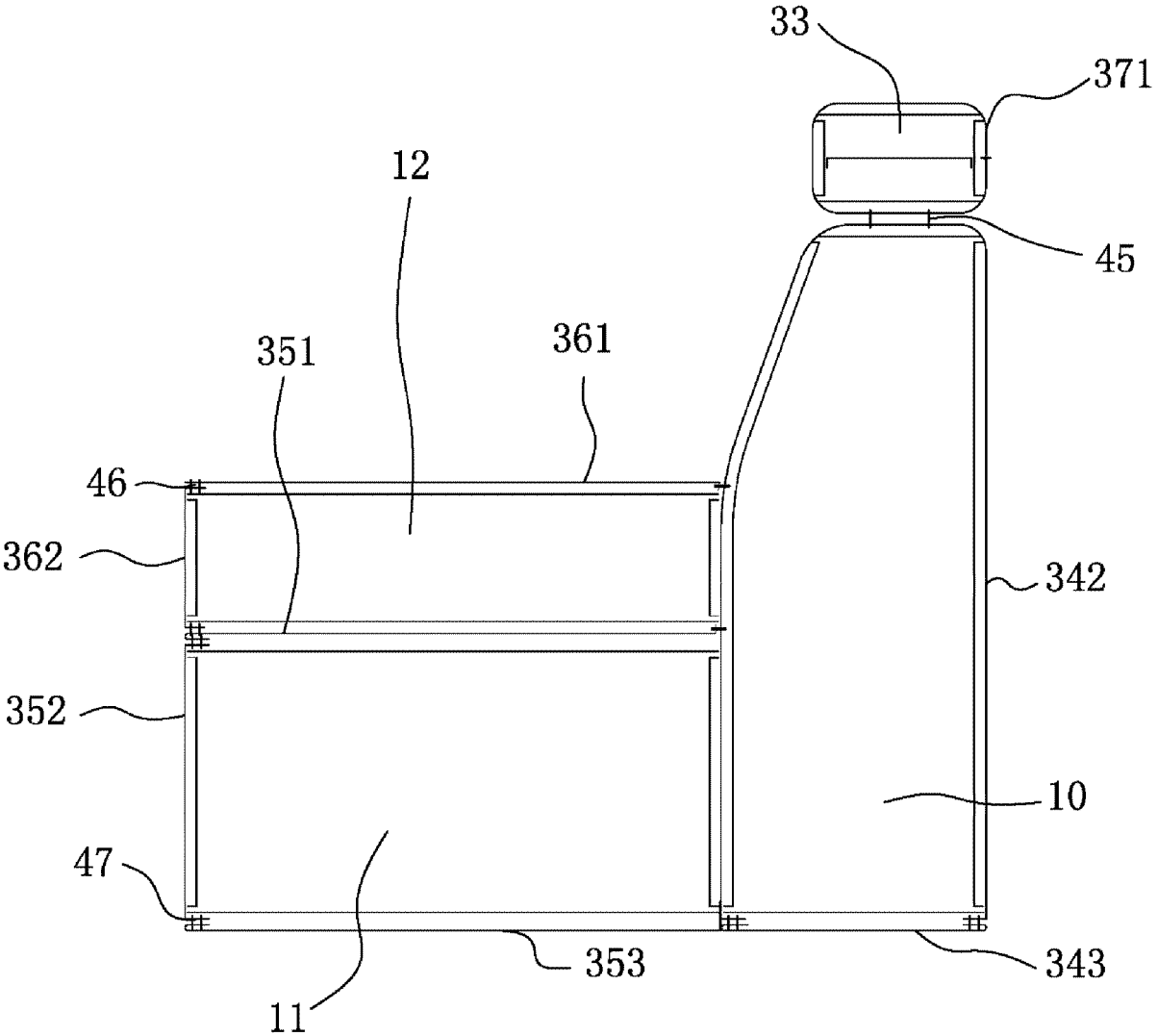
FIG. 19*b* depicts a front end of another backrest cloth cover joined to a rear end of a cushion cloth cover of the invention.
Figure 20:
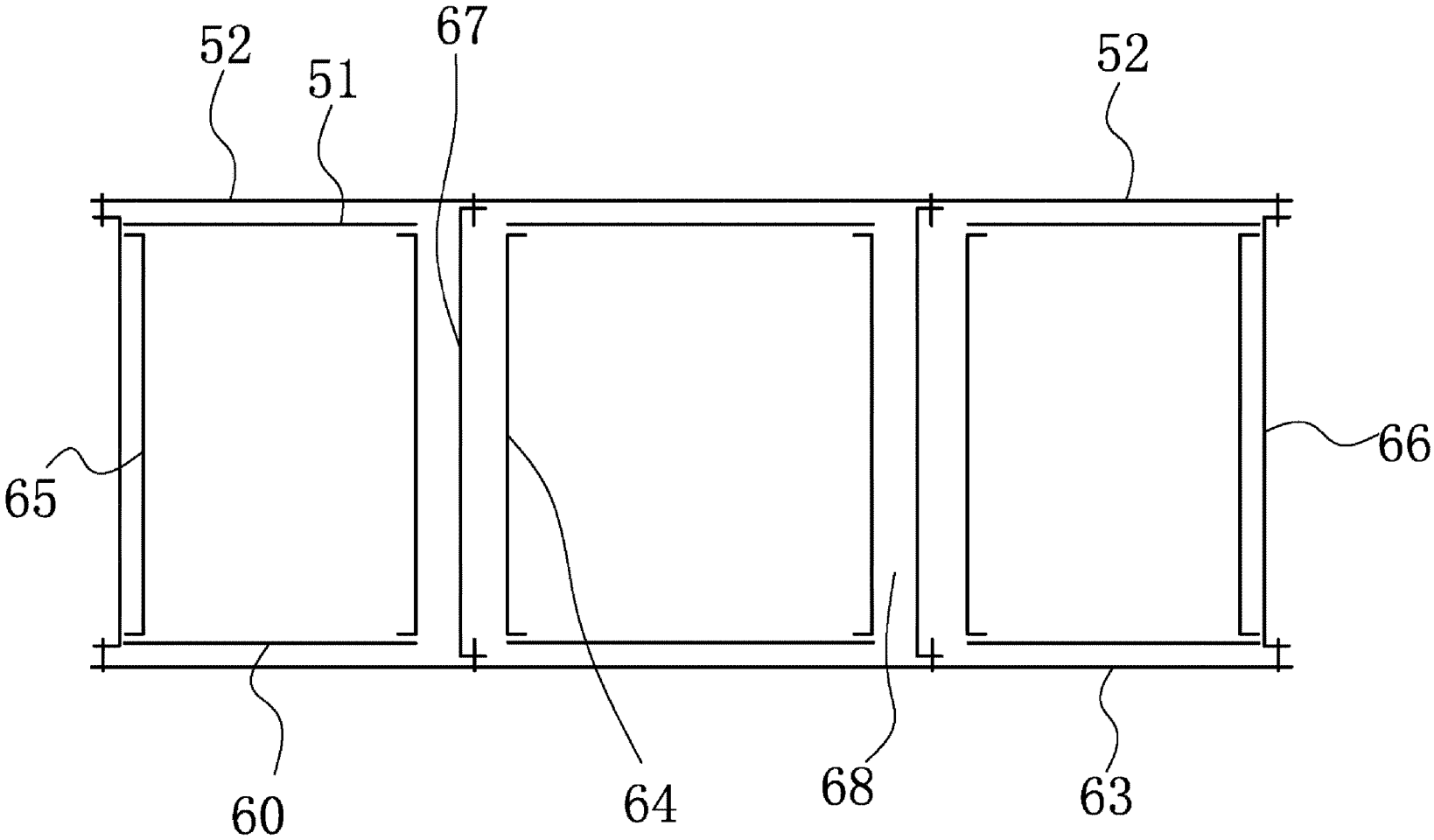
FIG. 20 depicts a structure of an upper sheet of a cloth cover secured to a lower sheet of the cloth cover by a strap extending through the inflatable body of the invention.

The upper sheet is joined to the peripheral sheet by sewing or zippers. Similarly, the lower sheet is joined to the peripheral sheet by sewing or zippers. As shown in FIGS. 19*a*, 19*b*, the cloth covers are joined to each other by sewing, attaching or latching. At least one securing member is disposed between the upper sheet and the lower sheet. As shown in FIG. 20, the inflatable body includes an upper member 51, a bottom member 60 and a periphery member 65. The cloth cover includes an upper sheet 52, a lower sheet 63 and a peripheral sheet 66. A limiting strap 67 is disposed between the upper sheet 52 and the lower sheet 63 to prevent the inflatable bodies from over inflation. The limiting strap 67 extends through a through hole 68 formed in the inflatable body to connect the upper sheet 52 and the lower sheet 63 so as to prevent the inflatable body from over inflation. The upper member 51 is secured to the bottom member 60 by a strap sleeve 64.

Figure 21:
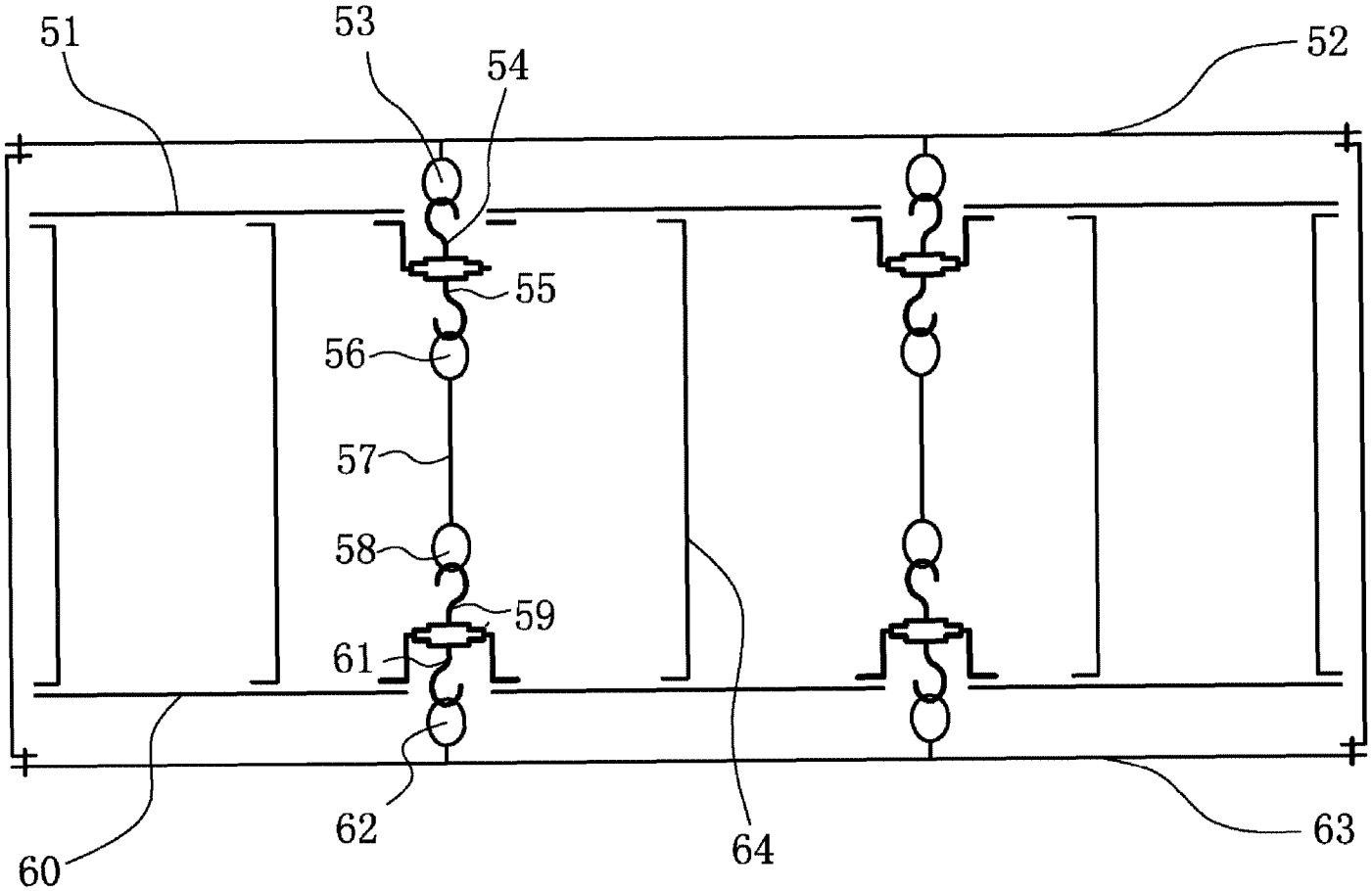
FIG. 21 depicts a structure of an upper sheet of a cloth cover secured to a lower sheet of the cloth cover by a plurality of securing members extending through the inflatable body of the invention.

Referring to FIG. 21, a securing ring 53 and a securing hook 54 connect an outer side of the upper member 51 and an inner side of the upper sheet 52. The inner side of the upper member 51 is secured to an inner side of the bottom member 60 through a securing hook 55, a securing ring 56, a pull strap 57, a securing ring 58 and a securing hook 59. An outer side of the bottom member 60 is secured to an inner side of the cloth cover 63 through a securing hook 61 and a securing ring 62. The upper member 51 is secured to the bottom member 60 by pull strap 64.

Figure 10:
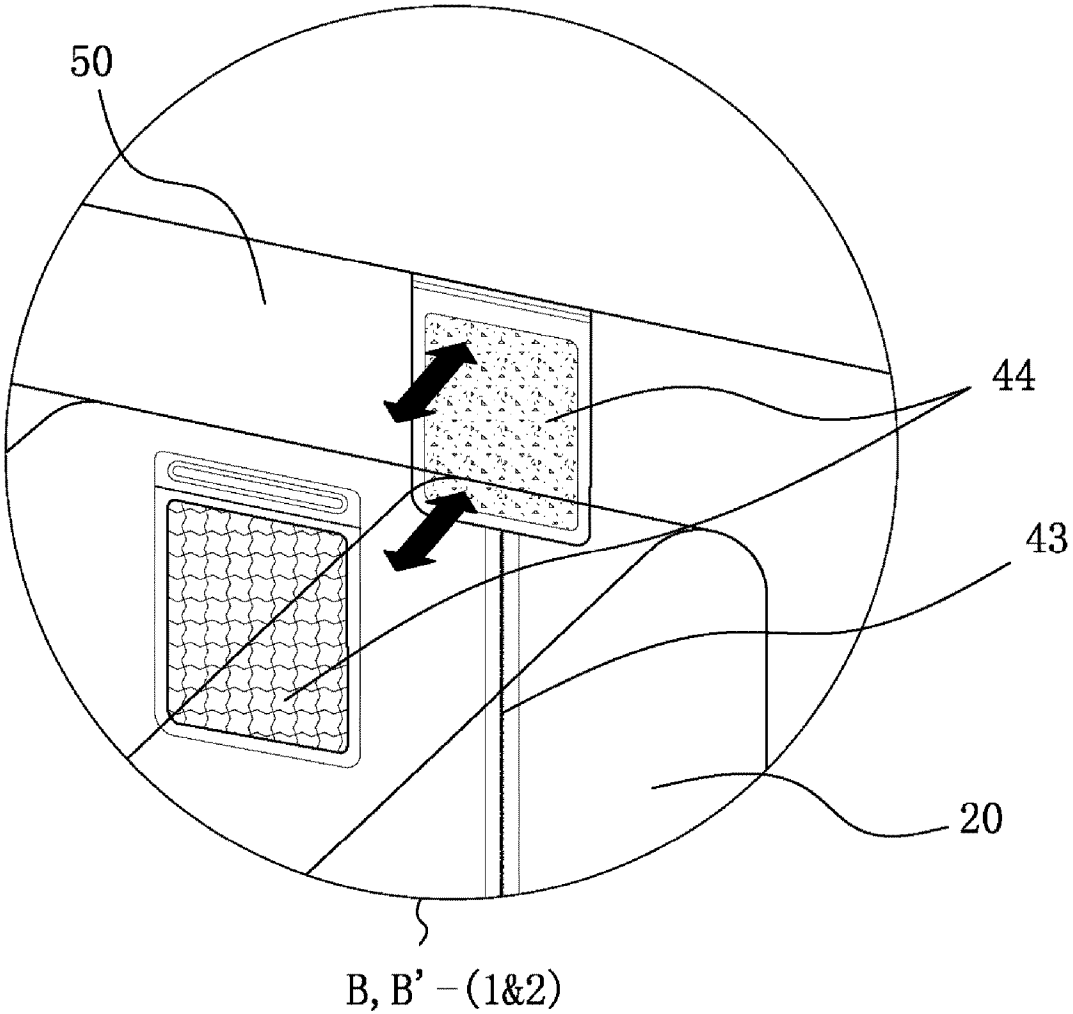
FIG. 10 is an enlarged view of the portions B and B' of FIG. 5.

Referring to FIGS. 5 and 10, a joining member 44 is disposed between the inflatable body 20 and the cloth cover set 50, whereby the inflatable body 20 is easily positioned in the cloth cover set 50. The joining member 44 can be a detachable bonding structure, such as Velcro.

The Third Embodiment

Figure 22:
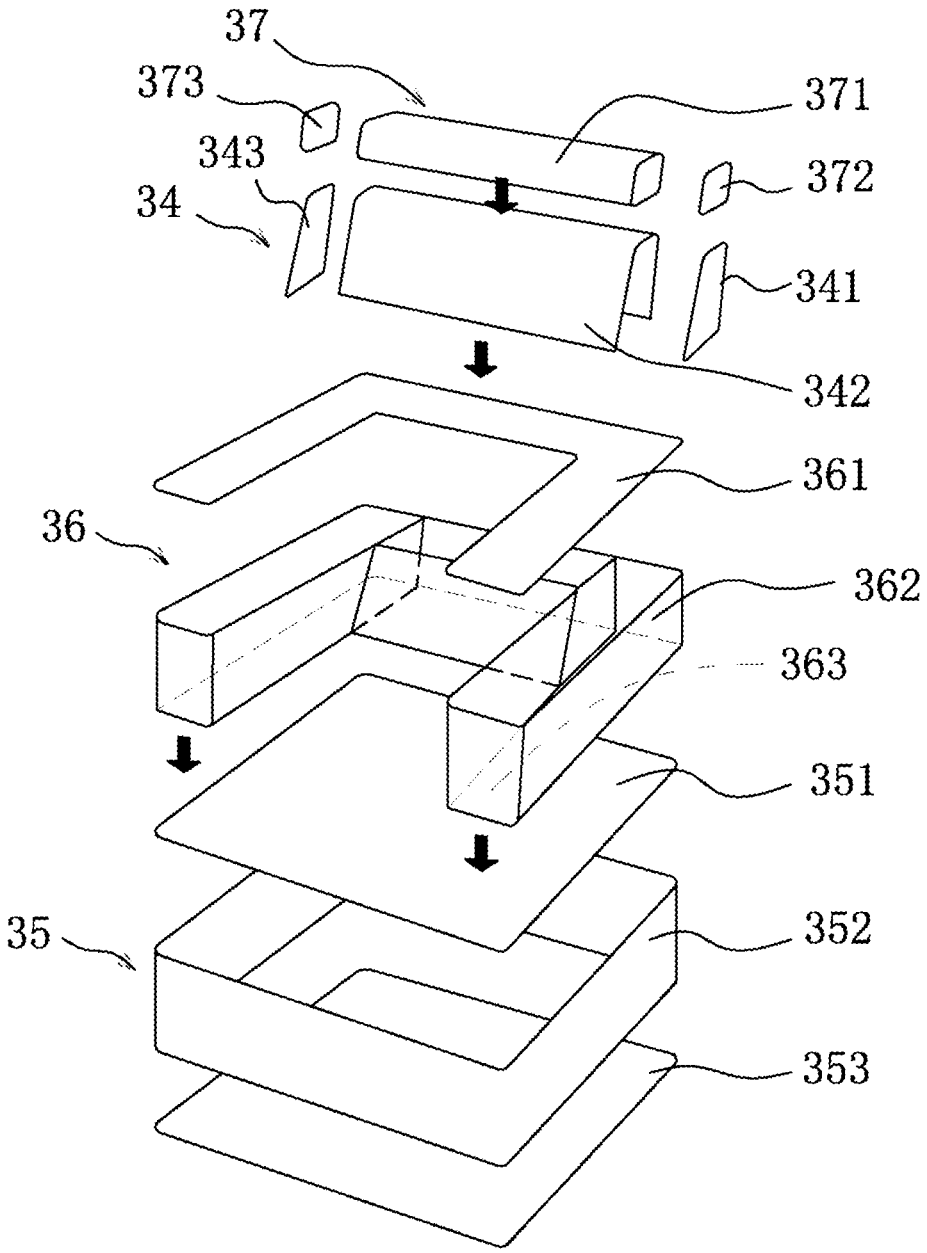
FIG. 22 is an exploded view of cloth covers of a sofa of the invention.
Figure 23:
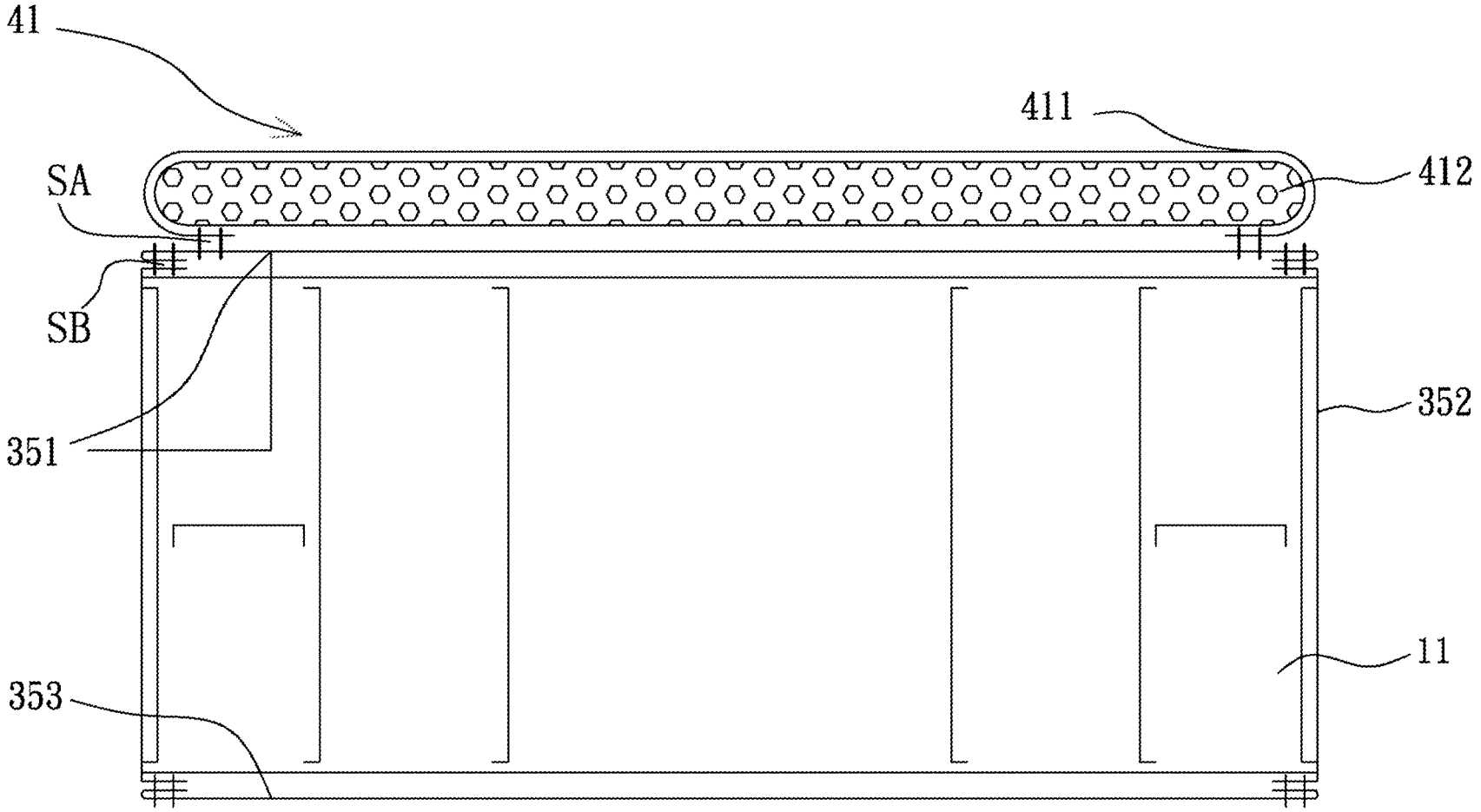
FIG. 23 is a cross section showing a cushion cloth cover of a cushion joined to a soft cushion cloth cover of a soft cushion of the invention.

This embodiment is a modification of the first embodiment. In this embodiment, a sofa including the inflatable bodies described in the previous embodiments is disclosed. The sofa includes a backrest, a cushion, an armrest and/or a head cushion. The inflatable bodies include a backrest inflatable body 10, a cushion inflatable body 11, an armrest inflatable body 12 and/or a head cushion inflatable body 33. Referring to FIG. 22, correspondingly, the cloth cover includes a backrest cloth cover 34, a cushion cloth cover 35, an armrest cloth cover 36 and/or a head cushion cloth cover 37. Referring to FIG. 23, the backrest cloth cover 34 includes a backrest upper sheet 341, a backrest peripheral sheet 342 and a backrest lower sheet 343. The cushion cloth cover 35 includes a cushion upper sheet 351, a cushion peripheral sheet 352 and a cushion lower sheet 353. The armrest cloth cover 36 includes an armrest upper sheet 361, an armrest peripheral sheet 362 and an armrest lower sheet 363. The head cushion cloth cover 37 includes a head cushion peripheral sheet 371, a head cushion upper sheet 372 and a head cushion lower sheet 373.

A cloth cover is fixed to adjacent another one of the cloth covers by sewing the peripheral sheet of the one of the cloth covers to the peripheral sheet of the another of the cloth covers, by sewing the upper sheet of the one of the cloth covers to the peripheral sheet of the another of the cloth covers, or by sewing the upper sheet of the one of the cloth covers to the upper sheet of the another of the cloth covers. As shown in FIGS. 19*a* and 19*b*, the peripheral sheet of the back cloth cover, the upper sheet of the armrest cloth cover and the peripheral sheet of the armrest cloth cover are joined together by sewing 38. The armrest partition material, the armrest peripheral sheet, the armrest upper sheet and the cushion upper sheet are joined together by sewing 39. The armrest peripheral sheet, the cushion upper sheet and the cushion peripheral sheet are joined together by sewing 40. A rear end of the cushion cloth cover is joined to a lower end of the backrest cloth cover by machine sewing.

The head cushion cloth cover is joined to the backrest peripheral sheet by sewing 45.

As shown in FIG. 19*a*, the head cushion inflatable body 33 is covered by head cushion cloth cover 37; the back rest inflatable body 10 is covered by backrest cloth cover 34; the cushion inflatable body 11 is covered by cushion cloth cover 35; the armrest inflatable body 12 is covered by armrest cloth cover 36. The head cushion peripheral sheet 371 of the head cushion cloth cover 37 is joined to the backrest peripheral sheet 342 of the backrest cloth cover 34 by sewing 45. The backrest peripheral sheet 342 is further joined to the armrest peripheral sheet 362 of the armrest cloth cover 36 and the cushion peripheral sheet 352 of the cushion cloth cover 35. The armrest peripheral sheet 362 of the armrest cloth cover 36 is joined to the cushion upper sheet 351.

The armrest upper sheet is secured to the armrest peripheral sheet by sewing 46. The cushion peripheral sheet is secured to cushion lower sheet by sewing 47.

Referring to FIG. 23, a soft cushion 41 is joined to the upper sheet of the cushion cloth cover 35. The soft cushion 41 includes a soft cushion cloth cover 411 and soft fillers 412 filled in the soft cushion cloth cover 411. The soft cushion cloth cover 411 is secured to the cushion cloth cover 35 by machine sewing. A lower edge of the soft cushion cloth cover is secured to an inner side of an outer edge of the cushion cloth cover by sewing (SA indicates the seams). An outer edge of the upper sheet of the cushion cloth cover is secured to an upper edge of the peripheral sheet of the cushion cloth cover by sewing (SB indicates the seams). The seams SA and B are separated to prevent the soft fillers from being squeezed by the cushion inflatable body to lose their elasticity.

Figure 24:
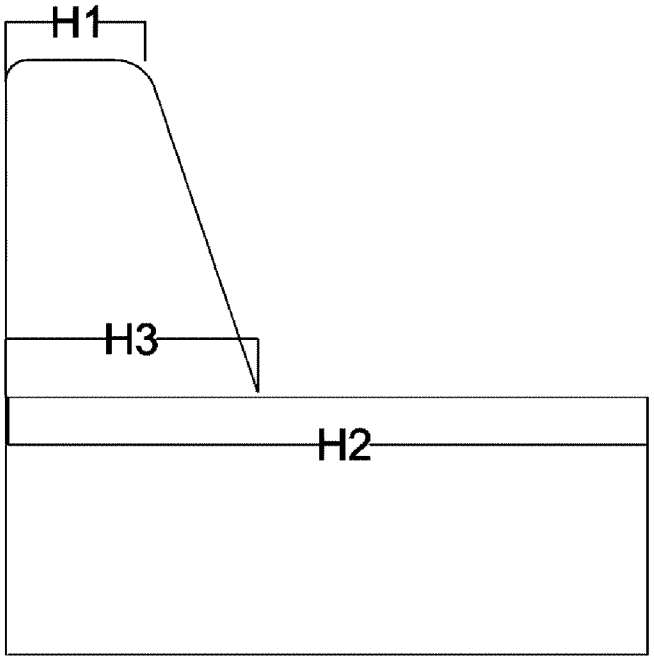
FIG. 24 depicts a ratio of a width of a backrest over a width of a cushion of the invention.

Referring to FIG. 24, the backrest has a top portion and a bottom portion, and a ratio of a width H1 of top portion over a width H2 of the cushion is 0.2 H1/H2 1, and a ratio of a width H3 of the bottom portion over the width H2 of the cushion is 0.4 H3/H2 1.

Figure 25:
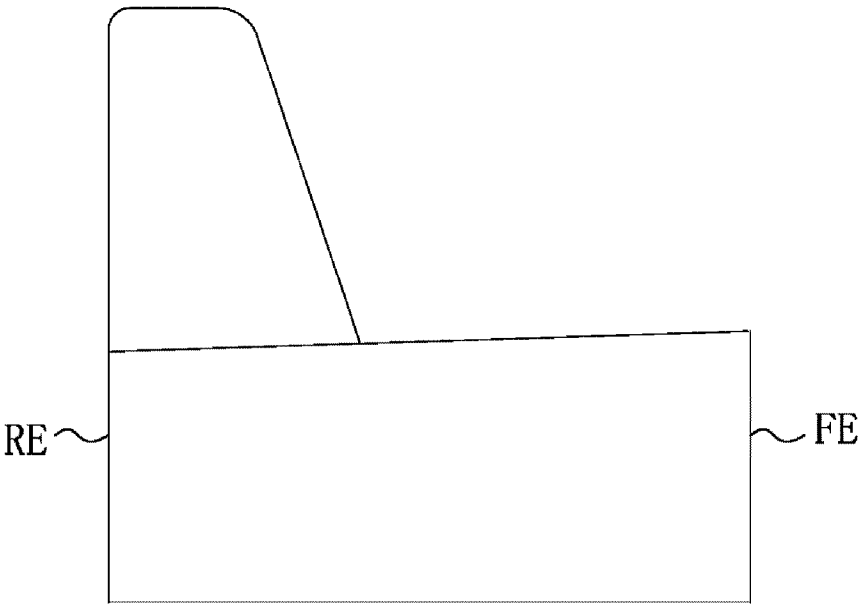
FIG. 25 depicts a cushion having a higher front end and a lower rear end of the invention.
Figure 27:
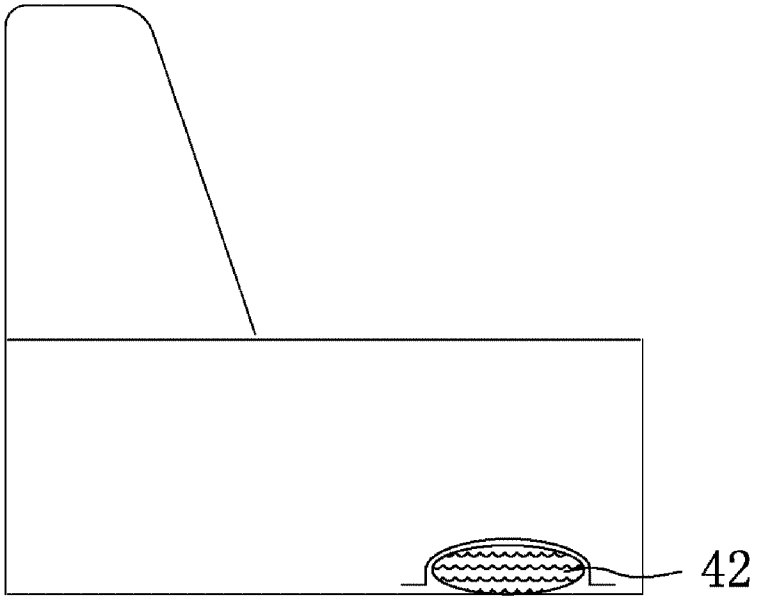
FIG. 27 depicts a weighting member disposed in a bottom and near a front end thereof.
Figure 26:
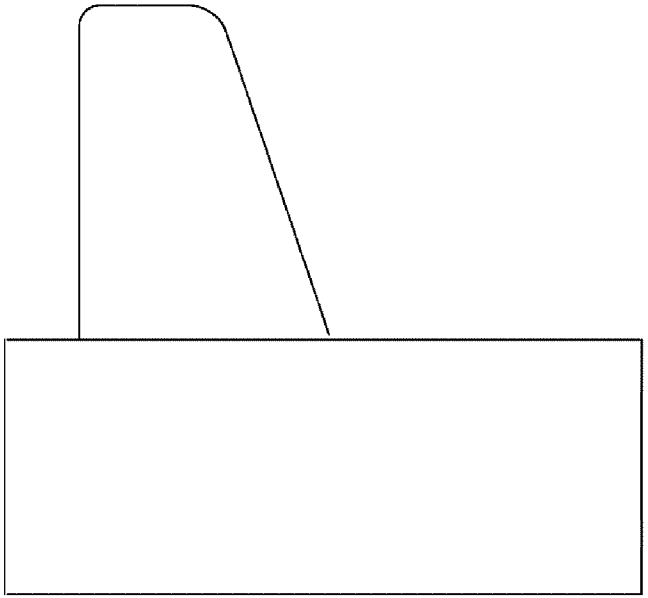
FIG. 26 depicts a rear end of a cushion separated from a lower end of a backrest to avoid overturn.

Referring to FIG. 25, the cushion has a front end FE and a rear end RE, and a height of the front end FE is greater than a height of the rear end RE. Referring to FIG. 26, a rear end of the cushion is separated from a rear end of the backrest by a distance. Referring to FIG. 27, a weighting member is disposed on a bottom of the cushion.

The Fourth Embodiment

An embodiment of the application provides an inflatable product. The inflatable product in accordance with this embodiment includes a plurality of inflatable bodies. A plurality of connecting members are disposed on the inflatable bodies. A plurality of gas pipes is disposed outside or within the inflatable bodies to connect the connecting members. The inflatable product further includes a gas pump, a regulation device and a multiport valve or multiport check valve. The gas pump, the regulation device and the multiport valve or the multiport check valve are connected to each other or connected to the inflatable bodies through the gas pipes and the connecting members so that the inflatable bodies are controlled to be connected or disconnected, whereby gas is introduced into or released from other inflatable product simultaneously.

The inflatable bodies are simultaneously inflatable through the multiport check valve, at least one of the inflatable bodies are gas sealed independently through the multiport check valve, the regulation device pushes a gas sealing device of each of the inflatable bodies to release gas simultaneously. The inflatable product is an inflatable sofa, and at least one inflatable cushion is gas sealed independently.

The application also provides an inflatable sofa. The inflatable sofa in accordance with this embodiment includes a plurality of cloth covers connected to each other. A plurality of inflatable bodies is covered by the cloth cover to serve as cushion, backrest or armrest. A plurality of connecting members are disposed on the inflatable bodies. A plurality of gas pipes disposed outside or within the inflatable bodies to connect the connecting members. The inflatable sofa further includes a gas pump, a regulation device connected to the gas pump, and a multiport valve or multiport check valve. The gas pump, the regulation device and the multiport valve or the multiport check valve are connected to the inflatable bodies through the connecting members and the gas pipes so that the cushion, the backrest and the armrest are connected or disconnected to each other, and the cushion, the backrest and the armrest are simultaneously inflatable or deflated with other inflatable bodies.

When the inflatable bodies are simultaneously inflated through the multiport check valve, at least one of the inflatable bodies are gas sealed independently through the multiport check valve. When deflated, the inflatable bodies release gas simultaneously through the regulation device to open the gas sealing device of each of the inflatable bodies.

In this embodiment, any of the cushions can be independently gas-sealed. The cloth covers covering the cushion and the backrest are joined in a position where the right-angled part of the cushion contacts the right-angled part of the backrest.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product comprising a plurality of inflatable bodies, each of which comprises an upper edge and an outer periphery, wherein the inflatable bodies are disposed together, an angle X1 between the upper edges of two adjacent inflatable bodies and a contact line of the outer peripheries of the two adjacent inflatable bodies ranges from 0 to 50°, $0 \leq X1 \leq 50°$; and another angle X2 of at least one concave portion formed on the outer periphery by pulling the outer periphery inward ranges from 120° to 180°, $120° \leq X2 \leq 180°$.

2. The inflatable product as claimed in claim 1, wherein:

each of the inflatable bodies comprises an upper member, a bottom member and a periphery member to form a gas chamber;

the upper member is fixed to the bottom member by a plurality of vertical pull straps, or the upper member is fixed to the bottom member by a plurality of vertical pull straps and an intermediate member mounted to the periphery member;

the periphery member is fixed to the upper member and the bottom member by a plurality of slant pull straps, or the periphery member is fixed to the vertical pull straps by a plurality of transverse pull straps.

3. The inflatable product as claimed in claim 1, further comprising a gas inflating/deflating device connected to one of the inflatable bodies, at least one connecting member connecting at least two inflatable bodies, and at least one gas pipe connecting the gas inflating/deflating device and the connecting member, wherein gas is introduced into or released from at least one of the inflatable bodies by the gas inflating/deflating device through the connecting member and the gas pipe.

4. The inflatable product as claimed in claim 1, further comprising a gas inflating/deflating device connected to one of the inflatable bodies, a plurality of connecting members connecting the inflatable bodies, and a plurality of gas pipes connecting the gas inflating/deflating device and the connecting members, wherein gas is introduced into or released from at least one of the inflatable bodies by the gas inflating/deflating device through the connecting members and the gas pipes.

5. The inflatable product as claimed in claim 4, further comprising a multiport valve, wherein the gas inflating/deflating device is connected to the gas pipes through the multiport valve to simultaneously introduce gas into the inflatable bodies or simultaneously release gas from the inflatable bodies.

6. The inflatable product as claimed in claim 5, wherein the multiport valve is a multiport check valve, and at least one inflatable body is gas sealed.

7. The inflatable product as claimed in claim 3, wherein the connecting member comprises a latch connector which is a single port connector having one port; and the gas inflating/deflating device introduces gas into or releases gas from the one of the inflatable bodies through the port of the single port connector.

8. The inflatable product as claimed in claim 3, wherein the connecting member comprises a latch connector which is a double port connector having two ports, and the gas inflating/deflating device introduces gas into or releases gas from at least one of the inflatable bodies through at least one of the ports of the double port connector and the other of the ports is connected to a connecting member of the inflatable bodies through the gas pipe.

9. The inflatable product as claimed in claim 1, further comprising at least one cloth cover which covers at least one inflatable body.

10. The inflatable product as claimed in claim 1 further comprising a plurality of cloth covers which cover the inflatable bodies, and are joined to each other.

11. The inflatable product as claimed in claim 9, wherein the cloth cover is hollow and comprises an accommodating space, and the accommodating space is smaller than a maximum volume of the at least one inflatable body.

12. The inflatable product as claimed in claim 11, wherein the cloth cover comprises an upper sheet, a lower sheet, and a peripheral sheet connecting the upper sheet and the lower sheet.

13. The inflatable product as claimed in claim 12, wherein the upper sheet is joined to the peripheral sheet by sewing or zippers, and the lower sheet is joined to the peripheral sheet by sewing or zippers.

14. The inflatable product as claimed in claim 11, wherein the cloth cover comprises an upper sheet, a plurality of lower sheets, and a peripheral sheet connecting the upper sheet and the lower sheets, and the lower sheets are joined by sewing or zippers.

15. The inflatable product as claimed in claim 11, wherein the cloth cover comprises a plurality of upper sheets, a lower sheet, and a plurality of peripheral sheets connecting the upper sheets and the lower sheet, and the peripheral sheets are joined by sewing.

16. The inflatable product as claimed in claim 11, wherein the cloth cover comprises a plurality of upper sheets, a lower sheet, and a plurality of peripheral sheets connecting the upper sheets and the lower sheet, and the peripheral sheets and the upper sheets are joined by sewing.

17. The inflatable product as claimed in claim 11, wherein the cloth cover comprises a plurality of upper sheets, a lower sheet, and a plurality of peripheral sheets connecting the upper sheets and the lower sheet, and the upper sheets are joined by sewing.

18. The inflatable product as claimed in claim 10, wherein the cloth covers are joined by sewing, attaching or latching.

19. The inflatable product as claimed in claim 12, further comprising a plurality of securing members disposed between the upper sheet and the lower sheet.

20. The inflatable product as claimed in claim 12, further comprising a plurality of securing members disposed on diagonal corners of the peripheral sheet.

* * * * *